US010711770B2

(12) United States Patent
Nikic

(10) Patent No.: US 10,711,770 B2
(45) Date of Patent: Jul. 14, 2020

(54) SEMICONDUCTOR MICRO-HOLLOW CATHODE DISCHARGE DEVICE FOR PLASMA JET GENERATION

(71) Applicant: The Boeing Company, Chicago, IL (US)

(72) Inventor: Dejan Nikic, Seattle, WA (US)

(73) Assignee: Thr Boeing Company, Chicago, IL (US)

( * ) Notice: Subject to any disclaimer, the term of this patent is extended or adjusted under 35 U.S.C. 154(b) by 547 days.

(21) Appl. No.: 15/494,669

(22) Filed: Apr. 24, 2017

(65) Prior Publication Data

US 2017/0314540 A1 Nov. 2, 2017

Related U.S. Application Data

(63) Continuation-in-part of application No. 15/143,517, filed on Apr. 30, 2016, now Pat. No. 10,271,415.

(51) Int. Cl.

| | |
|---|---|
| ***F03H 1/00*** | (2006.01) |
| ***H05H 1/54*** | (2006.01) |
| ***H05H 1/24*** | (2006.01) |

(52) U.S. Cl.

CPC ..... *F03H 1/0081* (2013.01); *H05H 1/2406* (2013.01); *H05H 1/54* (2013.01); *H05H 2001/2412* (2013.01); *H05H 2001/2437* (2013.01)

(58) Field of Classification Search

CPC .... F03H 1/0093; F03H 1/0006; F03H 1/0025; F03H 1/0087; B64G 1/405; B64G 1/406; H05H 1/2406; H05H 2001/2412; H01J 61/09; H01J 37/32825

See application file for complete search history.

(56) References Cited

U.S. PATENT DOCUMENTS 5,686,789 A * 11/1997 Schoenbach ..... H01J 1/025 313/491
2008/0290799 A1* 11/2008 Eden ..... H01J 1/025 313/582
2015/0239552 A1 8/2015 Nikic (Continued)

OTHER PUBLICATIONS

Schoenbach "Microhollow Cathode Discharge Excimer Lamps" (Year: 2000).*

(Continued)

*Primary Examiner* — Gerald L Sung
*Assistant Examiner* — William L Breazeal
(74) *Attorney, Agent, or Firm* — McDonnell Boehnen Hulbert & Berghoff LLP

(57) ABSTRACT

A micro-hollow cathode discharge device. The device includes a first electrode layer comprising a first electrode. A hole is disposed in the first electrode layer. The device also includes a dielectric layer having a first surface that is disposed on the first electrode layer. The hole continues from the first electrode layer through the dielectric layer. The device also includes a semi-conducting layer disposed on a second surface of the dielectric layer opposite the first surface. The semi-conducting layer is a semiconductor material that spans across the hole such that the hole terminates at the semi-conducting layer. The device also includes a second electrode layer disposed on the semi-conducting layer opposite the dielectric layer.

20 Claims, 16 Drawing Sheets

(56) References Cited

U.S. PATENT DOCUMENTS

2016/0107203 A1 4/2016 Nikic

OTHER PUBLICATIONS

Nisshin "Carbon Conductive Double-faced Adhesive Tapes ,Tabs, and Sheets" (Year: 2012).*
Schoenbach et al., "Microhollow Cathode Discharges", American Institute of Physics, 1996, 3 pages.
Hwang et al., "Diffusion-Controlled Glow Discharge Pressure Extended by the Multi-Dual Microhollow Cathode Configuration for Flat Lighting", The Japan Society of Applied Physics, 2010, 3 pages.
Becker et al., "Microplasmas and applications", Institute of Physics Publishing, Journal of Physics D: Applied Physics 39, 2006, 17 pages.
Shi et al, "Parallel Operation of Microhollow Cathode Discharges", IEEE Transactions on Plasma Science, vol. 27, No. 1, Feb. 1999, 2 pages.
Kim et al., "A Micromachined Flexible Hollow Cathode Discharge Device", Japanese Journal of Applied Physics 48, 2009, 4 pages.
Fukuhara et al., "Characterization of a Microhollow Cathode Discharge Plasma in Helium or Air with Water Vapor", Plasma Science and Technology, vol. 15, No. 2, Feb. 2013, 4 pages.
Kolb et al., "Cold Atmospheric Pressure Air Plasma Jet for Medical Applications", American Institute of Physics, Applied Physics Letters 92, 241501, 2008, 4 pages.
Biborosch et al, "The Influence of an External Magnetic Field on a "Macro" Hollow Cathode Discharge in Argon", 28th ICPIG, Jul. 15-20, 2007, Prague, Czech Republic, 4 pages.

* cited by examiner

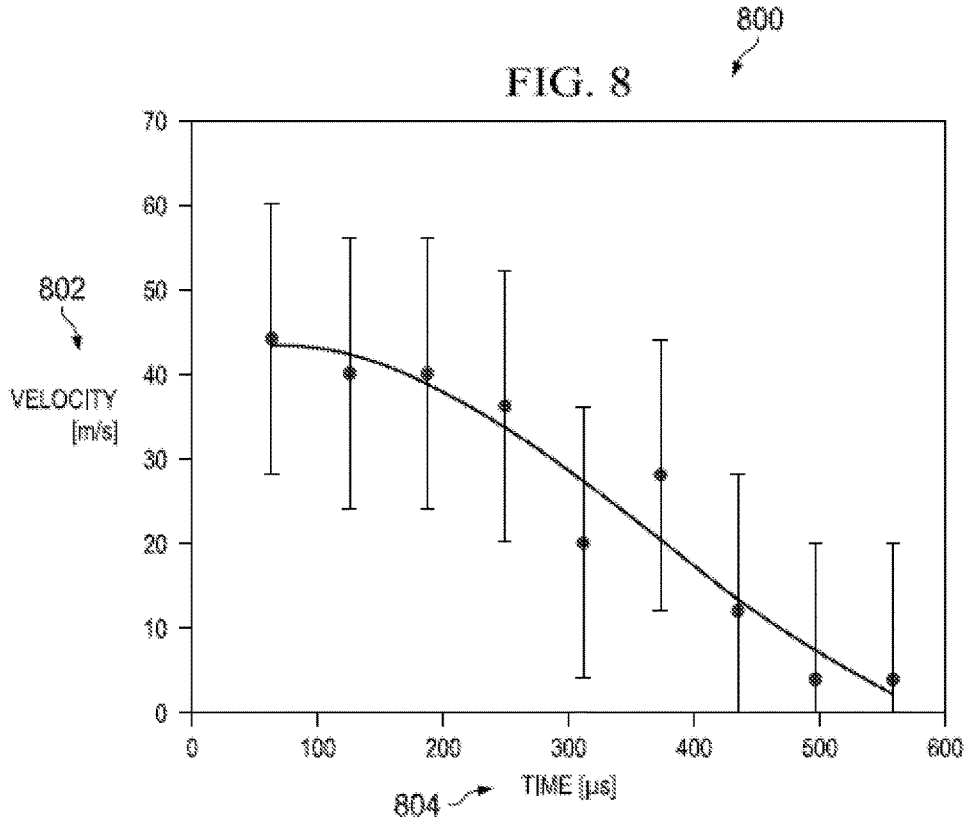
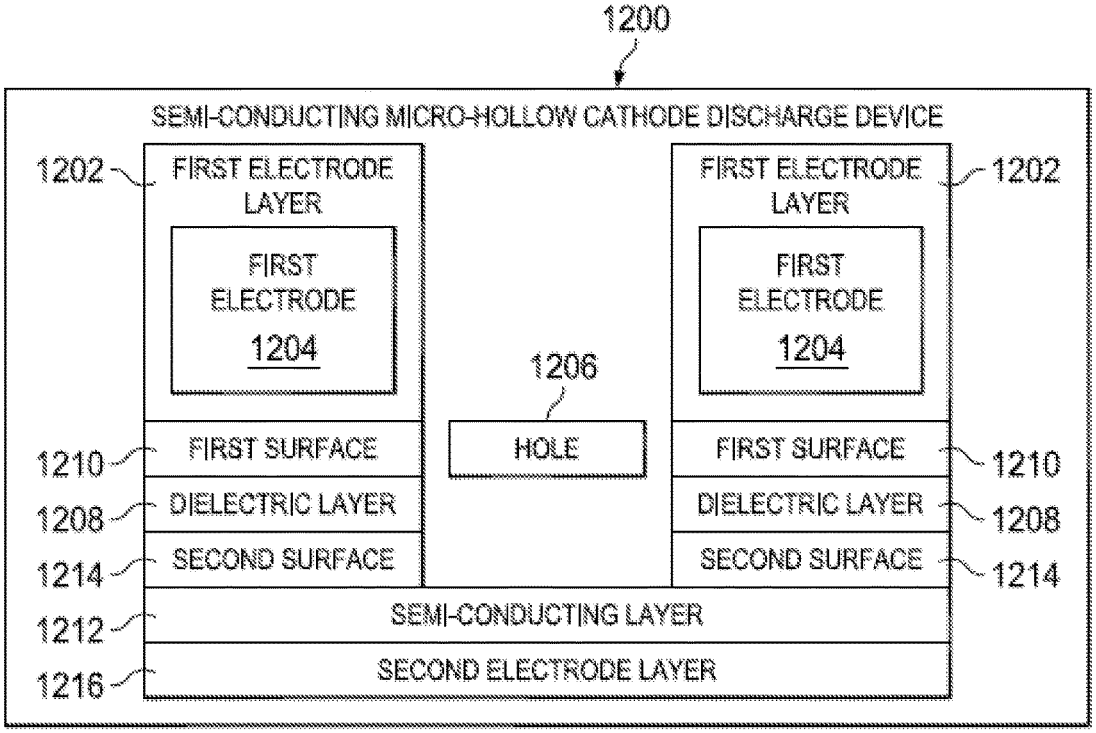
FIG. 9

SEMICONDUCTOR MICRO-HOLLOW CATHODE DISCHARGE DEVICE FOR PLASMA JET GENERATION

CROSS REFERENCE TO RELATED APPLICATION

The present disclosure is a continuation-in-part of U.S. patent application Ser. No. 15/143,517 filed on Apr. 30, 2016, the entire contents of which are herein incorporated by reference.

BACKGROUND INFORMATION

1. Field

The present disclosure relates to plasma jet generation in micro-hollow cathode discharge devices.

2. Background

Small satellite missions can be accomplished with simple spacecraft, which may or may not include propulsive capability. Small satellites typically do not have any on-board thrust capability due to the fact that most thrusters would dwarf, in size, the satellite on which they are powering. With propulsive capability, however, a range of missions that can be accomplished with a given size of spacecraft can be greatly enhanced since the spacecraft is able to maneuver.

One type of propulsion includes chemical rocket propulsion, in which propellant is given thermal energy by a violent chemical reaction. By expanding exhaust gases through a nozzle, a temperature and pressure of the gases is reduced, and energy is converted into kinetic energy of a jet.

Another type of propulsion includes electric propulsion, in which a propellant's kinetic energy is derived from electrical energy. Many existing electric thrusters are bulky and require fuel lines and complex electrode geometry which may not be suitable for small scale satellites, such as CubeSats. For some applications, electric thrusters of a desirable size are only possible using an external gas flow to enhance a length of the thruster. However, integrating thrusters that rely on gas flow into small scale satellites may be problematic in applications where only thin structures or confined spaces are available, because gas flow-based thrusters tend to be too bulky for such applications.

SUMMARY

The illustrative embodiments provide for a micro-hollow cathode discharge device. The device includes a first electrode layer comprising a first electrode. A hole is disposed in the first electrode layer. The device also includes a dielectric layer having a first surface that is disposed on the first electrode layer. The hole continues from the first electrode layer through the dielectric layer. The device also includes a semi-conducting layer disposed on a second surface of the dielectric layer opposite the first surface. The semi-conducting layer is a semiconductor material that spans across the hole such that the hole terminates at the semi-conducting layer. The device also includes a second electrode layer disposed on the semi-conducting layer opposite the dielectric layer.

The illustrative embodiments also provide for a method of generating a plasma jet from a micro-hollow cathode discharge device comprising a first electrode layer comprising a first electrode, wherein a hole is disposed in the first electrode layer; a dielectric layer having a first surface that is disposed on the first electrode layer, wherein the hole continues from the first electrode layer through the dielectric layer; a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer. The method includes generating a plasma jet from the hole by applying a voltage across the first electrode and the second electrode.

The illustrative embodiments also provide for a method of manufacturing a micro-hollow cathode discharge device. The method includes manufacturing a dielectric layer having a first surface and a second surface opposite the first surface. The method also includes placing a first electrode layer comprising a first electrode onto the first surface, wherein a hole is disposed in the first electrode layer. The hole continues from the first electrode layer through the dielectric layer. The method also includes placing a semi-conducting layer onto the second surface of the dielectric layer. The semi-conducting layer includes a semiconductor material that spans across the hole such that the hole terminates at the semi-conducting layer. The method also includes placing a second electrode layer onto the semi-conducting layer opposite the dielectric layer.

The illustrative embodiments also provide for an example thruster device including a first electrode layer having a plurality of holes extending through the first electrode layer, and a dielectric layer having a first surface that is disposed on the first electrode layer. The plurality of holes extend through the dielectric layer. The thruster device also includes a semi-conductor layer disposed on a second surface of the dielectric layer opposite the first surface, and the semi-conductor layer is exposed to the plurality of holes. The thruster device also includes a second electrode layer disposed on the semi-conductor layer opposite the dielectric layer, and an applied voltage across the first electrode layer and the second electrode layer causes a plurality of plasma plumes to be expelled toward the first electrode layer and out of the plurality of holes.

The illustrative embodiments also provide for another example thruster device including a plurality of plasma plume nozzles arranged in parallel, and each plasma plume nozzle comprises a layering of a first electrode layer, a dielectric layer, a semi-conductor layer, and a second electrode layer. The layering includes a hole extending through the first electrode layer and the dielectric layer to expose the semi-conductor layer, and an applied voltage across the first electrode layer and the second electrode layer causes a plasma plume to be expelled toward the first electrode layer and out of the hole. The thruster device also includes a plurality of insulators positioned between the plurality of plasma plume nozzles to prevent arcing across the plurality of nozzles.

The illustrative embodiments also provide for a method of producing a propulsive force from an example thruster device. The thruster device includes a plurality of plasma plume nozzles arranged in parallel, and each plasma plume nozzle comprises a layering of a first electrode layer, a dielectric layer, a semi-conductor layer, and a second electrode layer. The layering includes a hole extending through the first electrode layer and the dielectric layer to expose the semi-conductor layer. The method includes applying voltage across the first electrode layer and the second electrode layer of at least one of the plurality of plasma plume nozzles to cause a plasma plume to be expelled toward the first electrode layer and out of the hole.

Various examples of the method(s) described herein may include any of the components, features, and functionalities of any of the other examples of the method(s) described herein in any combination.

The features, functions, and advantages that have been discussed can be achieved independently in various examples or may be combined in yet other examples further details of which can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

FIG. 8 is an illustration of a graph of approximate velocity of a ballasted plasma jet generated by a semi-conducting micro-hollow cathode discharge device, in accordance with an illustrative embodiment;

FIG. 9 is an illustration of a block diagram of a semi-conducting micro-hollow cathode discharge device, in accordance with an illustrative embodiment;

DETAILED DESCRIPTION

The illustrative embodiments recognize and take into account that advances in power supply technology have made simple atmospheric plasma sources readily achievable. These devices can be used for processing, flow control, medical applications, thrusters, etc. Exact application will determine the configurations of the device itself. One of the simplest configurations for generation of plasma jets are micro-hollow cathode discharges (MHCD). Traditional MHCD devices have been operated under a range of pressure conditions and gas mixtures. However, operations in air have been performed either with lower than atmospheric pressures or using an external supply of air flow on the order of 100 m/s.

For many industrial applications a preferred plasma generator would not require external gas supply and would be able to operate at atmospheric conditions. Achieving such operational parameters would allow miniaturization of the device and easily integrate it into a variety of structures. Formed and flexible MHCD devices would also be easier to manufacture.

Thus, improvements to a micro-hollow cathode discharge are made to enhance the plasma jet exhaust with the assistance of a semi-conducting layer inserted at the bottom of the cathode hole. Large plasma jets are observed using micro-hollow cathode discharge devices without the need for an external source of high velocity gas. With the proposed configuration 10-20 mm long plasma jets are produced with exhaust velocities of 45 m/s. Further investigations, which included high speed imaging and spectroscopy, are performed. Based on the findings it has been concluded that compact high-performance plasma jets are possible.

Figure 1:
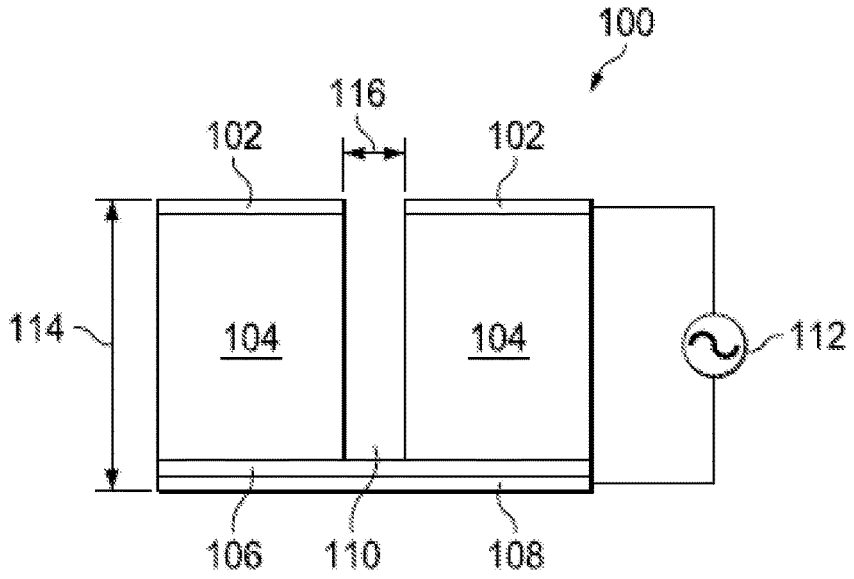
FIG. 1 is an illustration of a semi-conducting micro-hollow cathode discharge device, in accordance with an illustrative embodiment.

FIG. 1 illustrates a semi-conducting micro-hollow cathode discharge device, in accordance with an illustrative embodiment. Semi-conducting micro-hollow cathode discharge device 100 includes several components. Structurally, semi-conducting micro-hollow cathode discharge device 100 includes four layers, including first electrode layer 102, dielectric layer 104, semi-conductor layer 106, and second electrode layer 108. Hole 110 extends through first electrode layer 102 and dielectric layer 104 to semi-conductor layer 106. Power supply 112 provides power to an electrode in first electrode layer 102 and to another electrode in second electrode layer 108.

Overall, semi-conducting micro-hollow cathode discharge device 100 may have dimensions as indicated by height arrows 114 and width arrows 116. In some illustrative embodiments, the height may be about 1.5 mm. The width of hole 110 may be 0.4 mm. The hole may be circular in some illustrative embodiments, with a radius of 0.4 mm. The overall width along width arrows 116 may be centimeters or longer. The breadth of semi-conducting micro-hollow cathode discharge device 100 (into and out of the page) may also be centimeters or longer. These dimensions may all be varied and do not necessarily limit the illustrative embodiments. The dimensions and shape of hole 110 may be generally in a range of about 0.1 mm to about 2 mm. The height of semi-conducting micro-hollow cathode discharge device 100 along height arrows 114 may vary between about 0.5 mm and 10 mm or greater. However, in some cases, even these ranges may be expanded.

Attention is now turned to an exemplary experimental apparatus used in developing and implementing the illustrative embodiments described herein. The following is exemplary only, as other apparatus may be used to implement the illustrative embodiments described herein.

A micro-hollow cathode discharge device (MHCD) is composed of a dielectric layer and metallic electrodes attached to the dielectric. Such devices may be built utilizing printed circuit boards (PCBs). A central hole in the micro-hollow cathode discharge device could be thought of as a vertical interconnect access (VIA) hole present in most circuit board designs.

The illustrative embodiments present a new configuration of a micro-hollow cathode discharge device to increase the performance of the plasma jet in atmospheric air. To enhance the performance of the micro-hollow cathode discharge device, a semi-conducting layer may be attached between one of the electrodes and the dielectric. This arrangement is shown in FIG. 1, where a cross-section of the device is drawn with primary layers of the device shown. Enclosing one end of the hole with the semi-conducting layer forces the electrical path between the two electrodes to include the semi-conductor as well. This configuration may be designated as a semi-conducting micro hollow cathode discharge (SC-MHCD).

Figure 2:
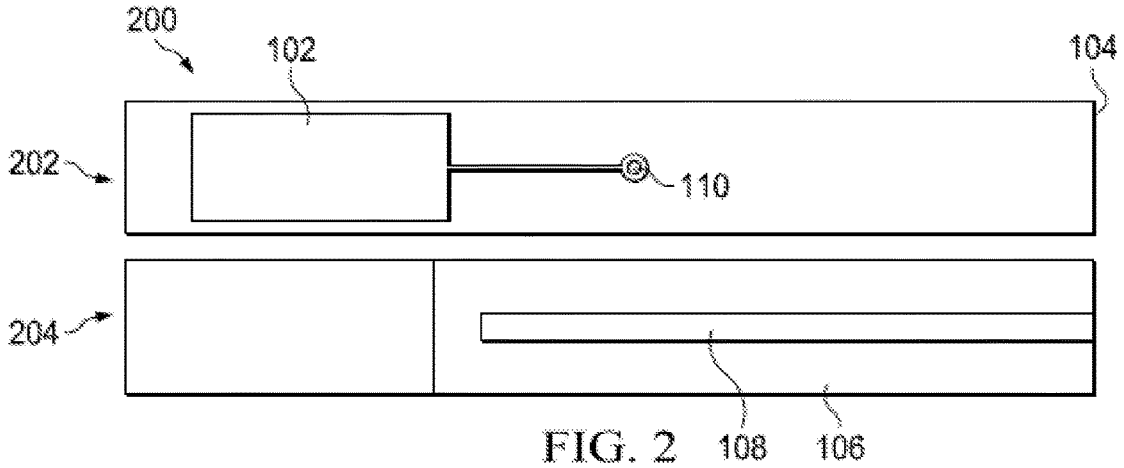
FIG. 2 is an illustration of a printed circuit board version of a semi-conducting micro-hollow cathode discharge device, in accordance with an illustrative embodiment.

FIG. 2 illustrates a printed circuit board version of a semi-conducting micro-hollow cathode discharge device, in accordance with an illustrative embodiment. Semi-conducting micro-hollow cathode discharge device 200 may be semi-conducting micro-hollow cathode discharge device 100. Thus, reference numerals in common with FIG. 1 share similar names and descriptions.

In FIG. 2, two views of semi-conducting micro-hollow cathode discharge device 200 are shown, a first side and a second side opposite the first side. First side 202 includes hole 110 and first electrode layer 102. Second side 204 showing both semi-conductor layer 106 and second electrode layer 108.

Attention is now turned to continuing the exemplary experimental apparatus of FIG. 1 used in developing and implementing the illustrative embodiments described herein. The following is exemplary only, as other experimental apparatus may be used to implement the illustrative embodiments described herein. Thus, the arrangement and shape of layers and other aspects of semi-conducting micro-hollow cathode discharge device 200 are not necessarily limited to what is shown or described in the following examples.

In the illustrative embodiment of FIG. 2, a small toroidal electrode, first electrode layer 102, is shown in the middle of the device. Hole 110 may be at a center of the toroid. Hole 110 may extend to semi-conductor layer 106 on the opposite side of the circuit board. Also shown are dielectric layer 104 and second electrode layer 108.

To create semi-conductor layer 106, a layer of carbon tape may be used. Carbon tape can be seen in FIG. 2 on second side 204 of semi-conducting micro-hollow cathode discharge device 200. In some illustrative embodiments, tape only needs to be applied to the small electrode area directly surrounding hole 110. For ease of manufacture, the tape may completely cover second side 204 of semi-conducting micro-hollow cathode discharge device 200.

Devices based on printed circuit board panels may show undesirable erosion in use, particularly on the dielectric which may show signs of melting. This erosion and melting may occur when copper and FR-4 are used for the dielectric on the printed circuit board. FR-4 is a grade designation assigned to glass-reinforced epoxy laminate sheets, tubes, rods and printed circuit boards. FR-4 is a composite material composed of woven fiberglass cloth with an epoxy resin binder that is flame resistant.

To achieve higher durability, 1.5 mm thick plates of MACOR® ceramic may be used to fabricate semi-conducting micro-hollow cathode discharge device 200. MACOR® is the trademark for a machinable glass-ceramic developed and sold by Corning Inc. MACOR® is composed of fluorphlogopite mica in a borosilicate glass matrix. However, plates of other materials may be used to achieve higher durability, including other types of ceramic materials.

To manufacture semi-conducting micro-hollow cathode discharge device 200, copper foil may be placed on the ceramic and a hole drilled through the foil and ceramic at the same time. A 400 micrometers drill bit may be used, but other drill bit sizes may be used for different illustrative embodiments. A second electrode may be built using layers of carbon tape and copper applied to the back of the ceramic substrate. These devices may built identical to the printed circuit board device shown in FIG. 2 and were shown to perform similarly. All of the data presented in this document is based on the semi-conducting micro-hollow cathode discharge devices built using the above arrangement of materials and techniques.

In other examples, the micro-hollow cathode discharge device 200 may be manufactured using electro-deposition processes, etching, or other printing processes as well to apply components onto a ceramic substrate.

Figure 3:
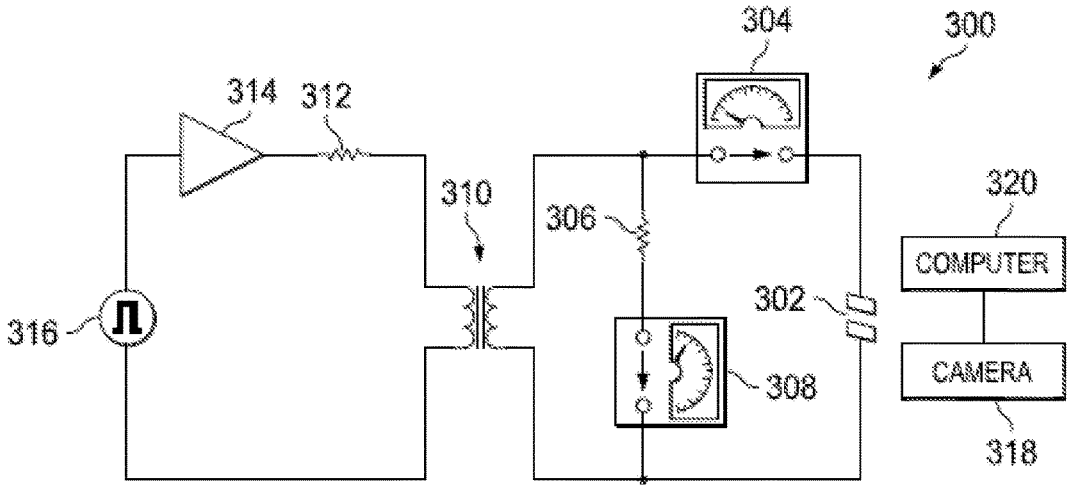
FIG. 3 is an illustration of an electrical schematic of a semi-conducting micro-hollow cathode discharge device, in accordance with an illustrative embodiment.

FIG. 3 illustrates an electrical schematic 300 of a semi-conducting micro-hollow cathode discharge device, in accordance with an illustrative embodiment. Semi-conducting micro-hollow cathode discharge device 302 may be semi-conducting micro-hollow cathode discharge device 100 of FIG. 2 or semi-conducting micro-hollow cathode discharge device 100 of FIG. 1.

Semi-conducting micro-hollow cathode discharge device 302 is connected to current probe 304, resistor 306, second current probe 308, and transformer 310, as shown in FIG. 3. Transformer 310 may be a high voltage flyback transformer, but other transformers or other devices capable of scaling up the voltage may be used. In turn, transformer 310 may be connected to resistor 312, power amplifier 314, and pulse generator 316, as arranged in FIG. 3. Camera 318 may be positioned to take images of a plasma jet emitted from semi-conducting micro-hollow cathode discharge device 302. Computer 320 may be in communication with camera 318 in order to record and process data taken by camera 318.

Other electrical arrangements are possible. In some illustrative embodiments one or both resistors may not be necessary or desirable. More or fewer current probes, or no current probes, may be present. A pulse generator may not be present. Thus, the illustrative embodiments are not necessarily limited to the example shown in FIG. 3.

Attention is now turned to continuing the specific exemplary apparatus of FIG. 1 and FIG. 2 used in developing and implementing the illustrative embodiments described herein. The following is exemplary only, as other experimental apparatus may be used to implement the illustrative embodiments described herein.

To power the semi-conducting micro-hollow cathode discharge device, a high voltage power supply may be used with the set of components shown in FIG. 3. Pulse generator 316 may be used to generate a low voltage rectangular signal, equivalent to a transistor-transistor logic (TTL) signal. The signal lasts 100 microseconds and is amplified with power amplifier 314. In a specific non limiting illustrative embodiment, power amplifier 314 may be an AE TECHRON MODEL 8101®.

To obtain high voltage, a flyback transformer may be used for transformer 310. The primary winding of the transformer may be connected to power amplifier 314, while the secondary is connected to semi-conducting micro-hollow cathode discharge device 302.

Resistor 312 may be used in series with power amplifier 314 to limit the current. Limiting the current may be performed to protect transformer 310. Thus, in different illustrative embodiments where transformer 310 does not need protection from a current generated by a particular arrangement, resistor 312 may not be needed or desirable.

To monitor the input of power to semi-conducting micro-hollow cathode discharge device 302, two current transformers (CTs) may be used, current probe 304 and current probe 308. In a specific illustrative embodiment, both current transformers may be PEARSON ELECTRONICS MODEL 2100®. The first current transformer, current probe 304, may be attached to the high voltage side of semi-conducting micro-hollow cathode discharge device 302, and it measures the current supplied to semi-conducting micro-hollow cathode discharge device 302. The second current transformer, current probe 308, measures current through a resistor connected in parallel with semi-conducting micro-hollow cathode discharge device 302. In a specific illustrative embodiment, resistor 306 may be about 40 kΩ. This measurement allows indirect measurement of the voltage across semi-conducting micro-hollow cathode discharge device 302 with decreased noise compared to voltage measurements performed directly using a high voltage probe.

As indicated above, camera 318 may be used to take images of the plasma jet emitted from semi-conducting micro-hollow cathode discharge device 302. In a specific illustrative embodiment, a NIKON D800® camera may be used to capture long exposure images of jets, while a VISION RESEARCH PHANTOM V640® camera may be used to provide high-speed imagery at 20,000 frames per second.

Spectroscopic measurements of the jets may be taken using an ANDOR SHAMROCK 500® spectrometer outfitted with ISTAR 320T® intensified charged couple device (CCD) camera. The light of the plasma jet may be coupled to the spectrometer via an optical fiber.

The measurements described herein may be used to obtain ionizing species information during testing. For initial surveying of the spectrum, a 300 l/mm grating may be utilized. Data presented in this document was obtained using a high resolution 1800 l/mm grating. A higher resolution grating may be chosen as a good compromise between wavelength resolution and detectable wavelength span. With a 1800 l/mm grating it was possible to obtain the spectral information spanning from 350 nm to 650 nm in 15 separate shots with a spectral resolution of 0.07 nm.

Figure 4:
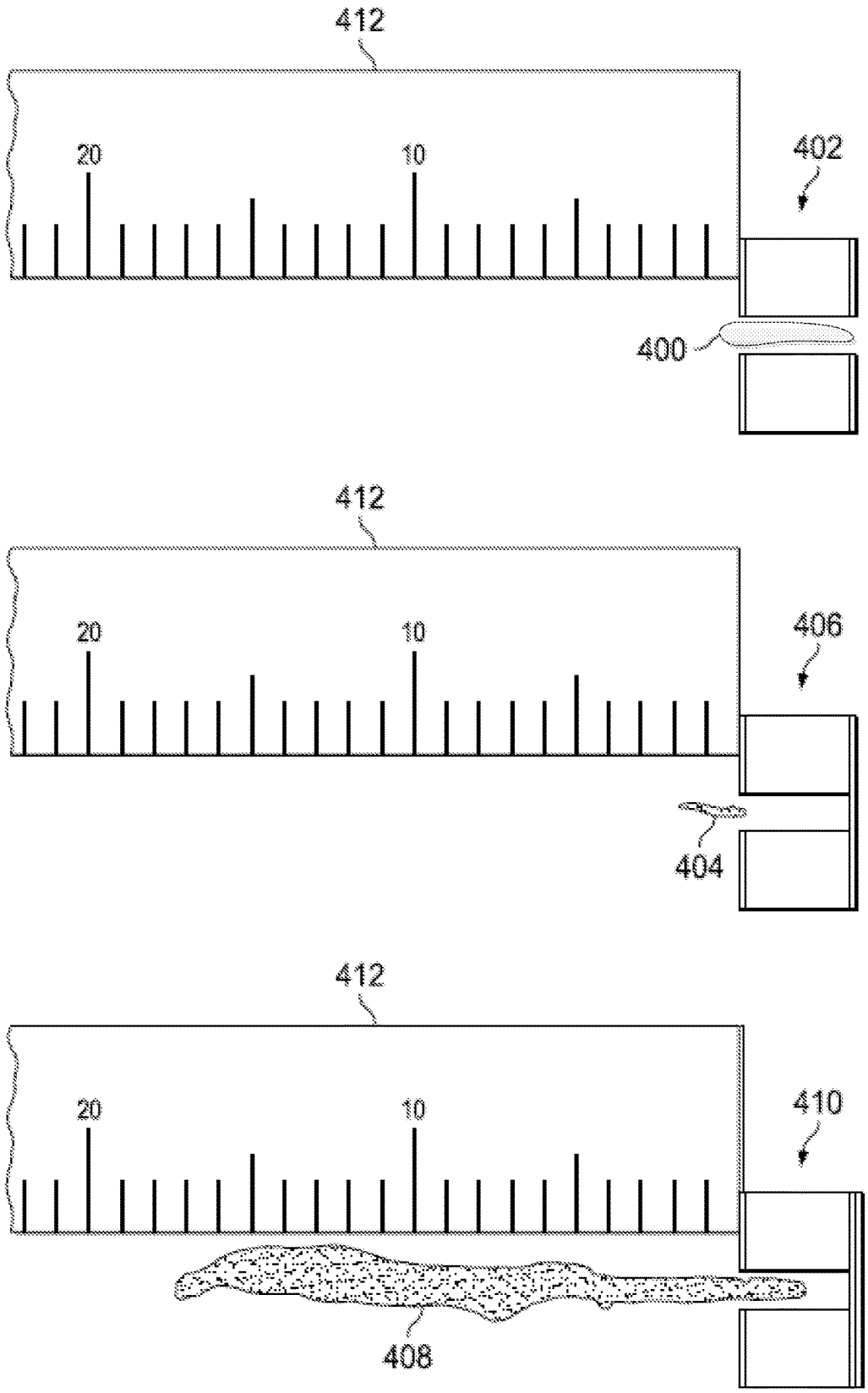
FIG. 4 is an illustration of a micro-hollow cathode discharge devices for purpose of comparing the resulting plasma jets for each device, in accordance with an illustrative embodiment.

FIG. 4 illustrates micro-hollow cathode discharge devices for purpose of comparing the resulting plasma jets for each device, in accordance with an illustrative embodiment. Thus, plasma jet 400 is generated by micro-hollow cathode discharge device 402; plasma jet 404 is generated by micro-hollow cathode discharge device 406; and plasma jet 408 is generated by semi-conducting micro-hollow cathode discharge device 410. For each jet, the same ruler 412 is used to measure the length of the jet. Micro-hollow cathode discharge device 402 uses a hole that extends through both electrodes and the dielectric material, with no semi-conductor layer. Micro-hollow cathode discharge device 406 uses a hole that extends to but not through the second electrode, with no semiconducting layer. Semi-conducting micro-hollow cathode discharge device 410 uses the arrangement shown in FIG. 1 and FIG. 2.

The measurements and illustrative embodiments described with respect to FIG. 4 are exemplary only, and may be varied. However, the measurements shown were taken with the specific exemplary experimental apparatus described above with respect to FIG. 1 through FIG. 3.

Continuing that example, comparison of different micro-hollow cathode discharge device configurations is shown in FIG. 4. The top two configurations are as described above. As shown in the right column of FIG. 4, penetration of the jets for these common configurations is poor. However, for semi-conducting micro-hollow cathode discharge device 410, a comparatively much larger jet is measured shooting out of the hole up to 15 mm in length, compared with at most 2 mm for micro-hollow cathode discharge device 406.

For each of the configurations investigated, a number of tests were performed to eliminate the effects of noise, fabrication inconsistencies, etc. With dozens of separate shots, each of the configurations performed consistently and only semi-conducting micro-hollow cathode discharge device 410 showed a significant improvement in jet size.

Based on these results a closer examination of semi-conducting micro-hollow cathode discharge device 410 was warranted. Semi-conducting micro-hollow cathode discharge device 410 showed a significant increase in jet size, which was not expected based on previous research shown at micro-hollow cathode discharge device 402 and micro-hollow cathode discharge device 406. The primary difference between the devices is that there is a layer of conductive carbon tape applied to the bottom electrode of semi-conducting micro-hollow cathode discharge device 410.

The tape used may be a scanning electron microscope (SEM) tape made by NISSHIN EM CO. and may be approximately 120 micrometers thick. In some cases the tape may be consumed during the jetting process. After a number of shots, usually more than 20, a single layer of SEM tape may be consumed. Multiple layers of SEM tape may be used to increase the number of available shots. No performance loss was noted with up to five layers of tape.

Using the methods described above, the electrical properties of semi-conducting micro-hollow cathode discharge device 410 were measured to determine power requirements. Based on the observation of many shots, only slight changes in electrical behavior were observed from shot to shot. The electrical properties of semi-conducting micro-hollow cathode discharge device 410 are described further below with respect to FIG. 5.

Figure 5:
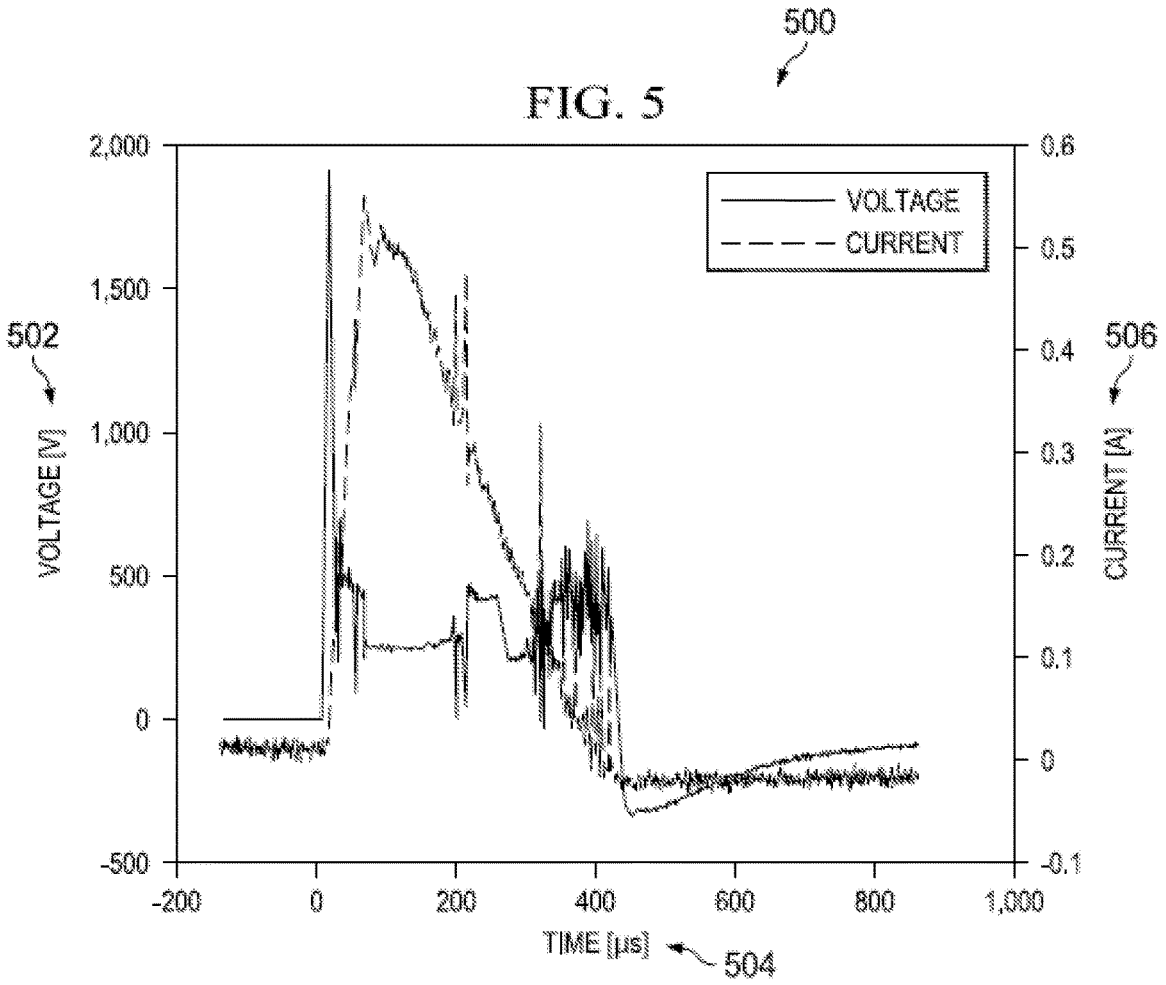
FIG. 5 is an illustration of a graph of electrical properties of a semi-conducting micro-hollow cathode discharge device, in accordance with an illustrative embodiment.

FIG. 5 is a graph of electrical properties of a semi-conducting micro-hollow cathode discharge device, in accordance with an illustrative embodiment. Graph 500 displays voltage 502 versus time 504 versus current 506 taken for a semi-conducting micro-hollow cathode discharge device, such as those described with respect to FIG. 1 through FIG. 4.

Attention is now turned to continuing the exemplary experimental apparatus of FIG. 1 through FIG. 4 used in developing and implementing the illustrative embodiments described herein. The following is exemplary only, as other experimental apparatus may be used to implement the illustrative embodiments described herein.

Full traces of current and voltage are shown in FIG. 5. Electrical properties of semi-conducting micro-hollow cathode discharge device 410 show a capacitive nature of the discharge with peak current of 500 mA. Initially the discharge requires a high voltage spike of almost 2000 V, which initiates the breakdown and generates the plasma. Once plasma is formed, a steady-state regime is entered during which voltage of 300-500 V is sufficient. The average power for the duration of the shot was computed to be 34.7 W.

A variety of current and voltage pulses to the semi-conducting micro-hollow cathode discharge device may be possible. However, the transformer used to generate the high voltage pulse for a discharge should accommodate the current. Inductive loading and discharge of the transformer provides the energy to the semi-conducting micro-hollow cathode discharge device, thereby limiting the nature of the current pulse in some applications. During high speed tests, the duty cycle of the power supply may be increased to determine if a near-steady stream of jets would be attainable.

With the example described above, a series of shots at a 100 Hz rate were performed. The power supply should provide sufficient power to generate jets at this rate. At 100 Hz discharges appear to behave uniformly throughout the duration of the high duty cycle test. With increased duty cycle the consumption of carbon tape increases as well. For these tests, multiple layers of carbon tape were used, which allowed 4-5 seconds of runtime at 100 Hz. Once the carbon tape is consumed the jetting process becomes sporadic and eventually starts to behave as plasma jet 404 from micro-hollow cathode discharge device 406 of FIG. 4.

Figure 6:
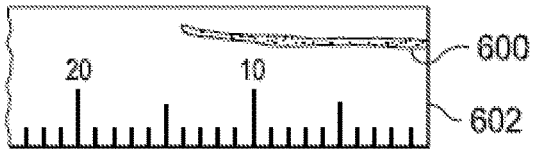
FIG. 6 is an illustration of a measurement of a jet from a semi-conducting micro-hollow cathode discharge device, in accordance with an illustrative embodiment.

FIG. 6 illustrates a measurement of a jet from a semi-conducting micro-hollow cathode discharge device, in accordance with an illustrative embodiment. Plasma jet 600 is another plasma jet generated using a semi-conducting micro-hollow cathode discharge device, such as those described with respect to FIG. 1 through FIG. 4. Ruler 602, which is the same as ruler 412 of FIG. 4, shows a measurement of plasma jet 600. Note that for different configurations of the semi-conducting micro-hollow cathode discharge device, different measurements may be observed.

Attention is now turned to continuing the exemplary experimental apparatus of FIG. 1 through FIG. 5 used in developing and implementing the illustrative embodiments described herein. The following is exemplary only, as other experimental apparatus may be used to implement the illustrative embodiments described herein.

FIG. 6 is derived from an actual high fidelity photograph of plasma jet 600, taken with a high resolution digital single lens reflex camera. The semi-conducting micro-hollow cathode discharge device of the illustrative embodiments produced a jet large enough that a standard ruler was sufficient for rough measurements of jet penetration. On average, jets of 10-20 mm length were achieved with ease.

Figure 7:
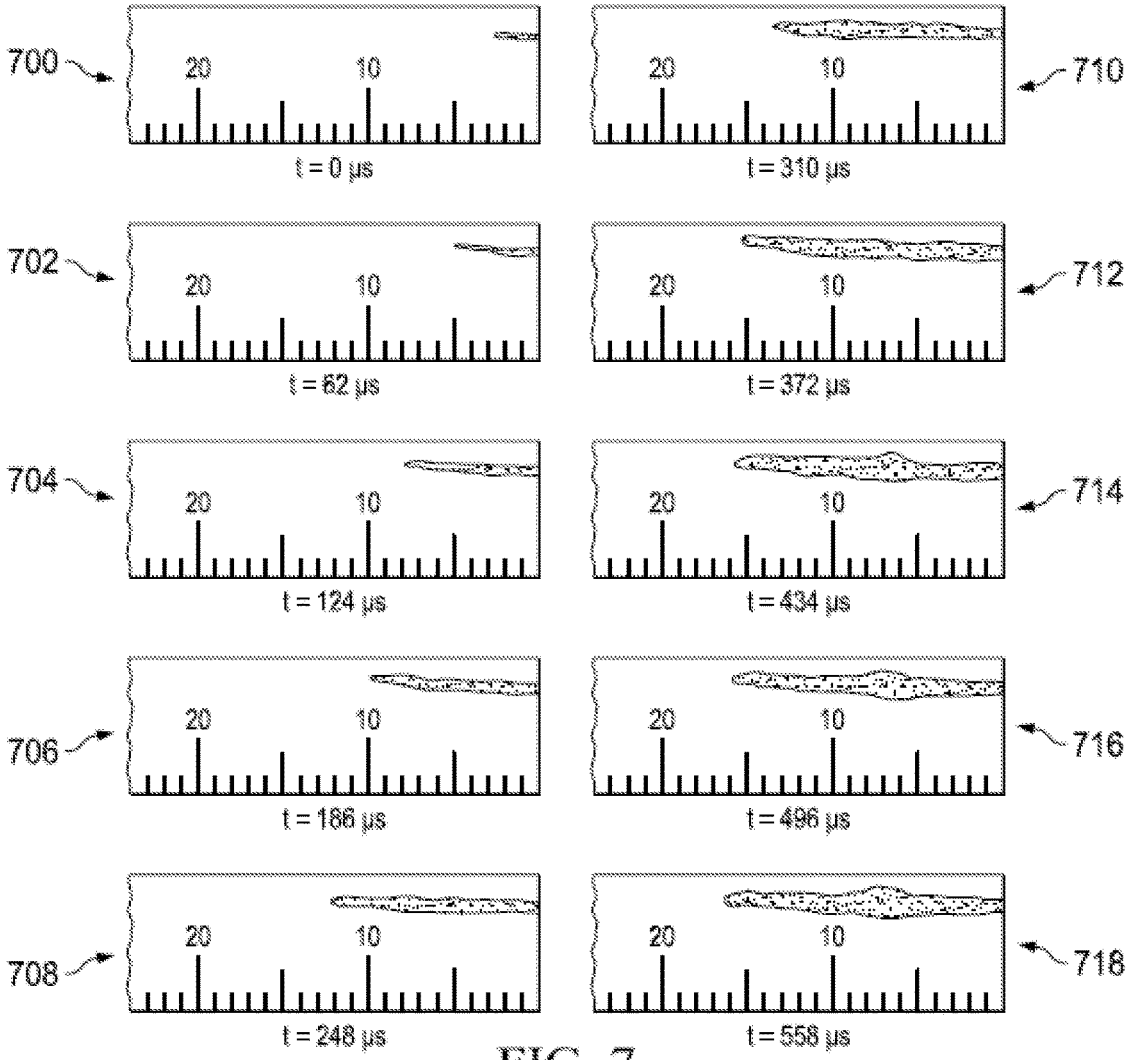
FIG. 7 is an illustration of a series of high speed images of plasma jets generated by a semi-conducting micro-hollow cathode discharge device, in accordance with an illustrative embodiment.

FIG. 7 is a series of high speed images of plasma jets generated by a semi-conducting micro-hollow cathode discharge device, in accordance with an illustrative embodiment. The semi-conducting micro-hollow cathode discharge device used to take the series of images shown in FIG. 7 may be any of the semi-conducting micro-hollow cathode discharge devices described with respect to FIG. 1 through FIG. 4.

The single shot nature of semi-conducting micro-hollow cathode discharge device prompted investigation of the temporal variation of the jet. A high speed camera was used to capture the development of a jet for the duration of the electrical current pulse. The results are shown in FIG. 7. The sequence of images proceeds in order from image 700 to image 702, image 704, image 706, image 708, image 710, image 712, image 714, image 716, and finally image 718. The time from initiation of the plasma jet is shown in each image.

The camera was triggered from the leading edge of the transistor-transistor logic (TTL) signal generated with a signal generator, which may be pulse generator 316 of FIG. 3. Due to the relative low-light nature of the plasma jet from the semi-conducting micro-hollow cathode discharge device, a full inter-frame time was used for exposure time, in this case 62 microseconds. The camera timestamps image 700 at just after 0 microseconds, yet the first evidence of the exhausting jet is already seen. This result is a side effect of a long exposure time in a rapidly changing environment around the semi-conducting micro-hollow cathode discharge device.

FIG. 8 is a graph of approximate velocity of a plasma jet generated by a semi-conducting micro-hollow cathode discharge device, in accordance with an illustrative embodiment. Graph 800 was generated by measuring a plasma jet from a semi-conducting micro-hollow cathode discharge device, such as those described with respect to FIG. 1 through FIG. 4. Graph 800 represents a relationship between velocity 802 of the plasma jet and time 804 after initiation of the plasma jet.

Attention is now turned to continuing the exemplary experimental apparatus of FIG. 1 through FIG. 7 used in developing and implementing the illustrative embodiments described herein. The following is exemplary only, as other experimental apparatus may be used to implement the illustrative embodiments described herein.

Approximation of the length growth of the jet can be made directly from the high-speed camera images shown in FIG. 7. In conjunction with the timing information provided by the camera, approximate exhaust velocity values can be computed. Velocities as function of time are shown in FIG. 8. These results were computed using the values obtained from images shown in FIG. 7.

Peak velocity of the jet happens during the initial phase of the pulse. The highest power levels of the electrical pulse are also measured during this time. This method allows an estimate of the exhaust velocities. With the peak velocity of 45 m/s, the semi-conducting micro-hollow cathode discharge device generates plasma jets that are 5-10 times slower than existing micro-hollow cathode discharge devices that utilize external gas flow.

CONCLUSIONS

The following are conclusions made with respect to the specific experiment described above in FIG. 1 through FIG. 8. A large micro-plasma jet operating in atmospheric air can be achieved with the semi-conducting micro-hollow cathode discharge device described above. Micro-plasmas generated from the 400 micrometers diameter hole are ejected up to 20 mm downstream with exhaust speeds in the excess of 45 m/s without the use of an external gas supply. Using the semi-conducting micro-hollow cathode discharge device described with respect to FIG. 1 through FIG. 4, plasmas with temperatures of 1.2-1.8 eV or 1 to 2 eV were demonstrated. The semi-conducting micro-hollow cathode discharge device of the illustrative embodiments produced large jets that rival or exceed existing flow-assisted devices already studied in great detail.

FIG. 9 is a block diagram of a semi-conducting micro-hollow cathode discharge device, in accordance with an illustrative embodiment. Semi-conducting micro-hollow cathode discharge device 1200 is a variation of the semi-conducting micro-hollow cathode discharge devices described with respect to FIG. 1 through FIG. 4.

Semi-conducting micro-hollow cathode discharge device 1200 includes first electrode layer 1202 including first electrode 1204. Hole 1206 is disposed in first electrode layer 1202.

Semi-conducting micro-hollow cathode discharge device 1200 also includes dielectric layer 1208 having first surface 1210 that is disposed on first electrode layer 1202. Hole 1206 continues from first electrode layer 1202 through dielectric layer 1208.

Semi-conducting micro-hollow cathode discharge device 1200 also includes semi-conducting layer 1212 disposed on second surface 1214 of dielectric layer 1208. Second surface 1214 is opposite first surface 1210, relative to dielectric layer 1208. Semi-conducting layer 1212 includes a semiconductor material that spans across hole 1206 such that hole 1206 terminates at semi-conducting layer 1212. Semi-conducting micro-hollow cathode discharge device 1200 also includes second electrode layer 1216 disposed on semi-conducting layer 1212 opposite dielectric layer 1208.

The illustrative embodiment described with respect to FIG. 9 may be varied. For example, a combined thickness of the first electrode layer, the dielectric layer, the semi-conducting layer, and the second electrode layer may be about 1.5 millimeters. This thickness may vary, but generally is on the order of centimeters or less.

In a specific illustrative embodiment, the hole is about 0.4 millimeters wide in a direction perpendicular to the combined thickness. However, the hole size may vary, generally on the order of 10 mm or less.

In another illustrative embodiment, the semi-conducting micro-hollow cathode discharge device may be a printed circuit board. However, other materials may be used, and the illustrative embodiments are not limited to printed circuit boards. Generally, any flame retardant dielectric material may be appropriate. In a more specific illustrative embodiment, the hole may be a vertical interconnect access hole about centered in the printed circuit board.

In an illustrative embodiment, the first electrode may be a toroidal electrode having a first area smaller than a second area of the first surface of the dielectric layer. However, the shape and the relative area of the electrodes may be varied to suit a particular application. Nevertheless, in a more specific illustrative embodiment, pads may be connected to the first electrode, the pads configured to receive electrical contacts.

In another specific illustrative embodiment, the semi-conducting layer may be carbon tape. The carbon tape may completely cover the second surface. The carbon tape has a first area, the second electrode has a second area, and the first area and the second area may be both smaller than a third area of the second surface of the dielectric layer. In still other illustrative embodiments, other semi-conducting materials may be used, and are not limited to carbon tape.

In yet another illustrative embodiment, the hole may be lined by a ceramic that is electrically insulating. The ceramic may be a machinable glass ceramic composed of fluorphlogopite mica in a borosilicate glass matrix. However, other flame retardant ceramics may be used.

In another illustrative embodiment, the micro-hollow cathode discharge device may further include a power supply attached to the first electrode and to the second electrode. The micro-hollow cathode discharge device may also include a pulse generator attached to the power supply and configured to generate a rectangular signal for power generated by the power supply.

The micro-hollow cathode discharge device may also include a transformer connected to the power supply and configured to increase a voltage supplied to the first electrode and the second electrode. In this example, the micro-hollow cathode discharge device may also include a resistor connected in series with the power supply and the first electrode and second electrode, and configured to reduce a current supplied to the first electrode and second electrode.

In a still different illustrative embodiment, the micro-hollow cathode discharge device may include a camera disposed to take an image of the hole, a spectrometer in communication with the camera, and a computer in communication with the spectrometer. The computer, which may be data processing system 1500 of FIG. 12, may be configured to analyze spectra of the image taken using the camera when a plasma jet is emitted from the hole as a result of power being applied to the first electrode and the second electrode.

Figure 10:
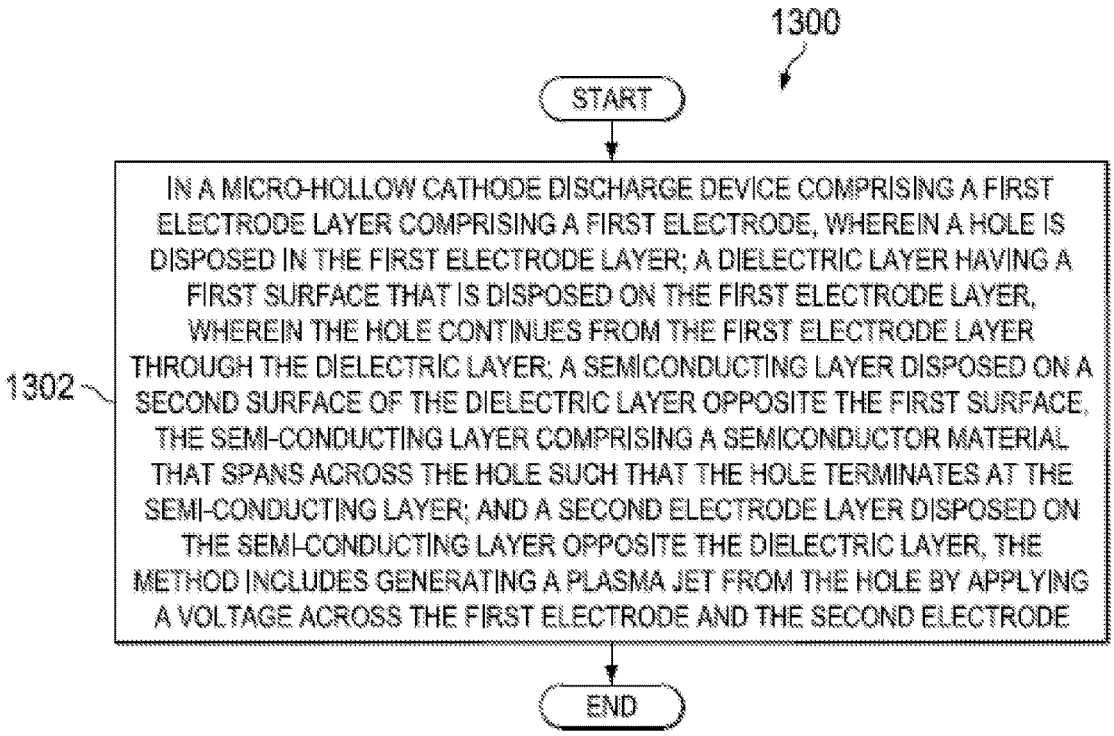
FIG. 10 is an illustration of a flowchart of a method of generating a plasma jet from a micro-hollow cathode discharge device, in accordance with an illustrative embodiment.

FIG. 10 is a flowchart of a method of generating a plasma jet from a micro-hollow cathode discharge device, in accordance with an illustrative embodiment. Method 1300 may be implemented using a semi-conducting micro-hollow cathode discharge device, such as those described with respect to FIG. 1 through FIG. 4, and FIG. 9.

Thus, method 1300 may be a method in a micro-hollow cathode discharge device comprising a first electrode layer comprising a first electrode, wherein a hole is disposed in the first electrode layer; a dielectric layer having a first surface that is disposed on the first electrode layer, wherein the hole continues from the first electrode layer through the dielectric layer; a semi-conducting layer disposed on a second surface of the dielectric layer opposite the first surface, the semi-conducting layer comprising a semiconductor material that spans across the hole such that the hole terminates at the semi-conducting layer; and a second electrode layer disposed on the semi-conducting layer opposite the dielectric layer. The method includes generating a plasma jet from the hole by applying a voltage across the first electrode and the second electrode (operation 1302).

This method may be varied. In just one example, generating the plasma jet may include generating the plasma jet to be greater than about 3 millimeters long. Further variations are possible.

Figure 11:
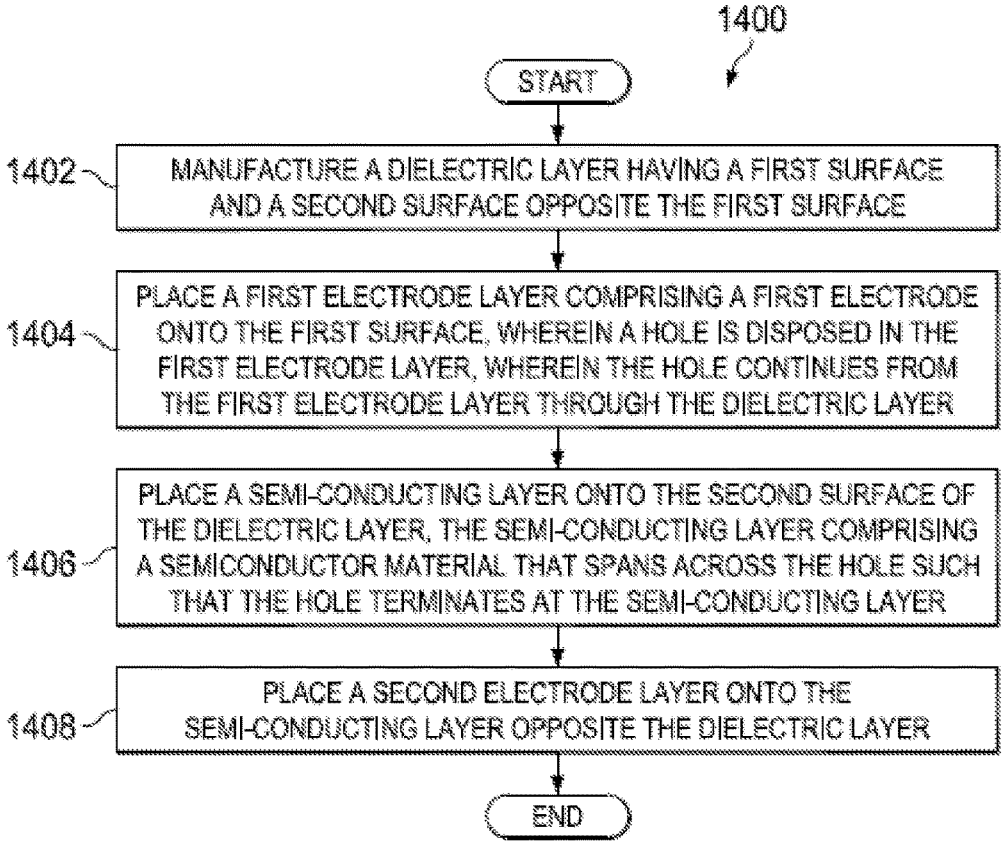
FIG. 11 is an illustration of a flowchart of a method of manufacturing a micro-hollow cathode discharge device, in accordance with an illustrative embodiment.

FIG. 11 is a flowchart of a method of manufacturing a micro-hollow cathode discharge device, in accordance with an illustrative embodiment. Method 1400 may be used to create a semi-conducting micro-hollow cathode discharge device, such as those described with respect to FIG. 1 through FIG. 4

Method 1400 may be a method of manufacturing a micro-hollow cathode discharge device. Method 1400 may include manufacturing a dielectric layer having a first surface and a second surface opposite the first surface (operation 1402). Method 1400 may also include placing a first electrode layer comprising a first electrode onto the first surface, wherein a hole is disposed in the first electrode layer, wherein the hole continues from the first electrode layer through the dielectric layer (operation 1404).

Method 1400 may also include placing a semi-conducting layer onto the second surface of the dielectric layer, the semi-conducting layer comprising a semiconductor material that spans across the hole such that the hole terminates at the semi-conducting layer (operation 1406). Method 1400 may also include placing a second electrode layer onto the semi-conducting layer opposite the dielectric layer (operation 1408). The method may terminate thereafter.

Method 1400 may be further varied. For example, as described above, different materials may be used. Different arrangements and shapes of the various layers may also be used. Accordingly, the illustrative embodiments are not necessarily limited by the example of FIG. 11, or the examples described above with respect to the other figures.

The illustrative embodiments described herein may be varied from the examples described above with respect to FIG. 1 through FIG. 11. For example, multiple semi-conducting micro-hollow cathode discharge devices may be arranged in a row as a single device, with each semi-conducting micro-hollow cathode discharge device attached to a single power supply in series. Thus, a row of jets may be generated. Other arrangements are possible. For example, multiple coordinated power supplies may be used for multiple semi-conducting micro-hollow cathode discharge devices. The semi-conducting micro-hollow cathode discharge devices may be arranged in different patterns, such as circular or elliptical or some other pattern, and thus are not limited to a row. Multiple coordinated semi-conducting micro-hollow cathode discharge devices may be arranged in a three-dimensional pattern on a larger apparatus by placing different semi-conducting micro-hollow cathode discharge devices on different parts of the larger apparatus. Thus, many different arrangements of multiple semi-conducting micro-hollow cathode discharge devices are possible.

Figure 12:
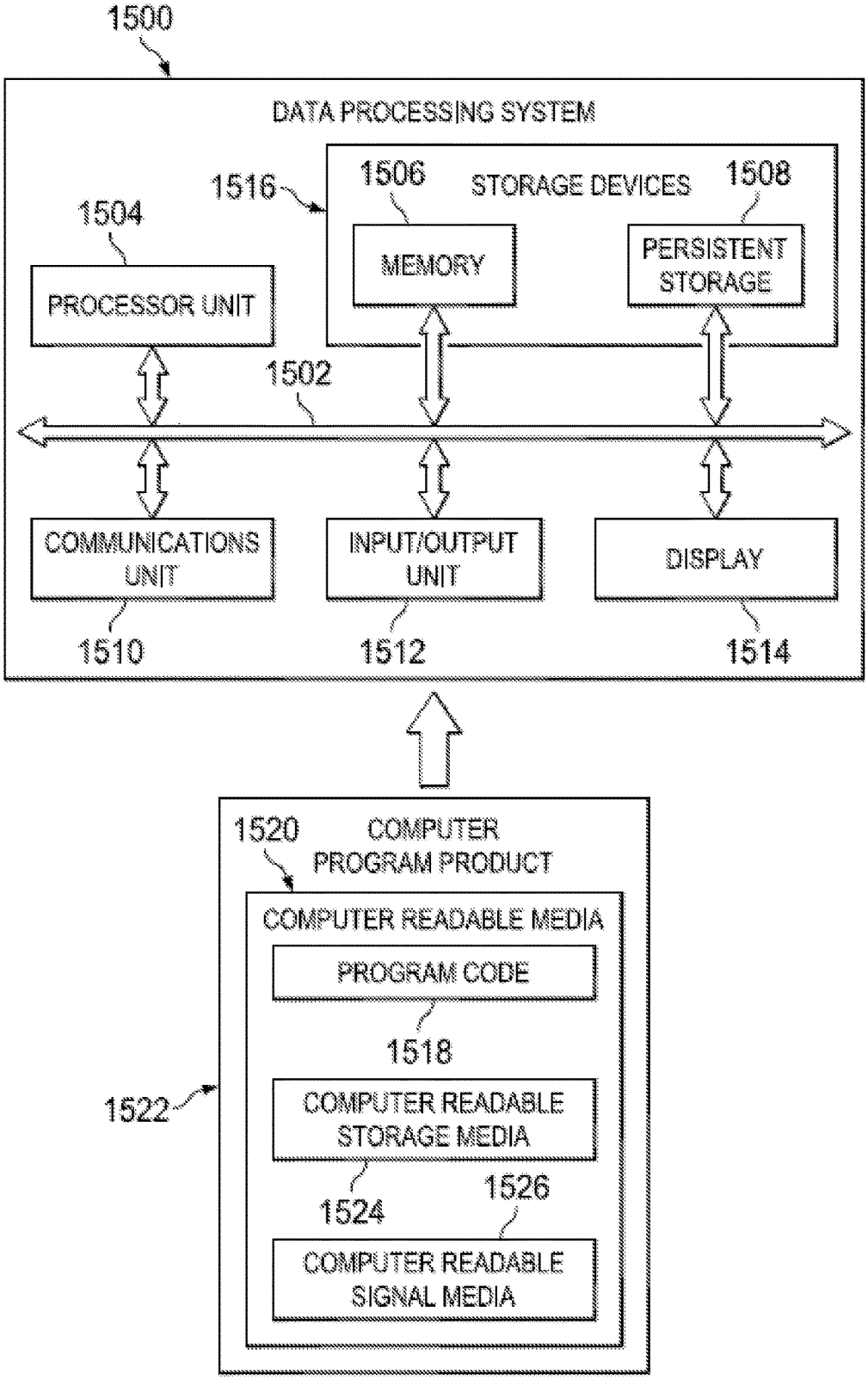
FIG. 12 is an illustration of a data processing system, in accordance with an illustrative embodiment.

Turning now to FIG. 12, an illustration of a data processing system is depicted in accordance with an illustrative embodiment. Data processing system 1500 in FIG. 12 is an example of a data processing system that may be used as part of the data taking and data processing described above for the illustrative embodiments described with respect to FIG. 1 through FIG. 11. In this illustrative example, data processing system 1500 includes communications fabric 1502, which provides communications between processor unit 1504, memory 1506, persistent storage 1508, communications unit 1510, input/output (I/O) unit 1512, and display 1514.

Processor unit 1504 serves to execute instructions for software that may be loaded into memory 1506. This software may be an associative memory, content addressable memory, or software for implementing the processes described elsewhere herein. Processor unit 1504 may be a number of processors, a multiprocessor core, or some other type of processor, depending on the particular implementation. A number, as used herein with reference to an item, means one or more items. Further, processor unit 1504 may be implemented using a number of heterogeneous processor systems in which a main processor is present with secondary processors on a single chip. As another illustrative example, processor unit 1504 may be a symmetric multiprocessor system containing multiple processors of the same type.

Memory 1506 and persistent storage 1508 are examples of storage devices 1516. A storage device is any piece of hardware that is capable of storing information, such as, for example, without limitation, data, program code in functional form, and/or other suitable information either on a temporary basis and/or a permanent basis. Storage devices 1516 may also be referred to as computer readable storage devices in these examples. Memory 1506, in these examples, may be, for example, a random access memory or any other suitable volatile or non-volatile storage device. Persistent storage 1508 may take various forms, depending on the particular implementation.

For example, persistent storage 1508 may contain one or more components or devices. For example, persistent storage 1508 may be a hard drive, a flash memory, a rewritable optical disk, a rewritable magnetic tape, or some combination of the above. The media used by persistent storage 1508 also may be removable. For example, a removable hard drive may be used for persistent storage 1508.

Communications unit 1510, in these examples, provides for communications with other data processing systems or devices. In these examples, communications unit 1510 is a network interface card. Communications unit 1510 may provide communications through the use of either or both physical and wireless communications links.

Input/output (I/O) unit 1512 allows for input and output of data with other devices that may be connected to data processing system 1500. For example, input/output (I/O) unit 1512 may provide a connection for user input through a keyboard, a mouse, and/or some other suitable input device. Further, input/output (I/O) unit 1512 may send output to a printer. Display 1514 provides a mechanism to display information to a user.

Instructions for the operating system, applications, and/or programs may be located in storage devices 1516, which are in communication with processor unit 1504 through communications fabric 1502. In these illustrative examples, the instructions are in a functional form on persistent storage 1508. These instructions may be loaded into memory 1506 for execution by processor unit 1504. The processes of the different embodiments may be performed by processor unit 1504 using computer implemented instructions, which may be located in a memory, such as memory 1506.

These instructions are referred to as program code, computer usable program code, or computer readable program code that may be read and executed by a processor in processor unit 1504. The program code in the different embodiments may be embodied on different physical or computer readable storage media, such as memory 1506 or persistent storage 1508.

Program code 1518 is located in a functional form on computer readable media 1520 that is selectively removable and may be loaded onto or transferred to data processing system 1500 for execution by processor unit 1504. Program code 1518 and computer readable media 1520 form computer program product 1522 in these examples. In one example, computer readable media 1520 may be computer readable storage media 1524 or computer readable signal media 1526. Computer readable storage media 1524 may include, for example, an optical or magnetic disk that is inserted or placed into a drive or other device that is part of persistent storage 1508 for transfer onto a storage device, such as a hard drive, that is part of persistent storage 1508. Computer readable storage media 1524 also may take the form of a persistent storage, such as a hard drive, a thumb drive, or a flash memory, that is connected to data processing system 1500. In some instances, computer readable storage media 1524 may not be removable from data processing system 1500.

Alternatively, program code 1518 may be transferred to data processing system 1500 using computer readable signal media 1526. Computer readable signal media 1526 may be, for example, a propagated data signal containing program code 1518. For example, computer readable signal media 1526 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 1518 may be downloaded over a network to persistent storage 1508 from another device or data processing system through computer readable signal media 1526 for use within data processing system 1500. For instance, program code stored in a computer readable storage medium in a server data processing system may be downloaded over a network from the server to data processing system 1500. The data processing system providing program code 1518 may be a server computer, a client computer, or some other device capable of storing and transmitting program code 1518.

The different components illustrated for data processing system 1500 are not meant to provide architectural limitations to the manner in which different embodiments may be implemented. The different illustrative embodiments may be implemented in a data processing system including components in addition to or in place of those illustrated for data processing system 1500. Other components shown in FIG. 12 can be varied from the illustrative examples shown. The different embodiments may be implemented using any hardware device or system capable of running program code. As one example, the data processing system may include organic components integrated with inorganic components and/or may be comprised entirely of organic components excluding a human being. For example, a storage device may be comprised of an organic semiconductor.

In another illustrative example, processor unit 1504 may take the form of a hardware unit that has circuits that are manufactured or configured for a particular use. This type of hardware may perform operations without needing program code to be loaded into a memory from a storage device to be configured to perform the operations.

For example, when processor unit 1504 takes the form of a hardware unit, processor unit 1504 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, programmable array logic, a field programmable logic array, a field programmable gate array, and other suitable hardware devices. With this type of implementation, program code 1518 may be omitted because the processes for the different embodiments are implemented in a hardware unit.

In still another illustrative example, processor unit 1504 may be implemented using a combination of processors found in computers and hardware units. Processor unit 1504 may have a number of hardware units and a number of processors that are configured to run program code 1518. With this depicted example, some of the processes may be implemented in the number of hardware units, while other processes may be implemented in the number of processors.

As another example, a storage device in data processing system 1500 is any hardware apparatus that may store data. Memory 1506, persistent storage 1508, and computer readable media 1520 are examples of storage devices in a tangible form.

In another example, a bus system may be used to implement communications fabric 1502 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 1506, or a cache, such as found in an interface and memory controller hub that may be present in communications fabric 1502.

The different illustrative embodiments can take the form of an entirely hardware embodiment, an entirely software embodiment, or an embodiment containing both hardware and software elements. Some embodiments are implemented in software, which includes but is not limited to forms such as, for example, firmware, resident software, and microcode.

Furthermore, the different embodiments can take the form of a computer program product accessible from a computer usable or computer readable medium providing program code for use by or in connection with a computer or any device or system that executes instructions. For the purposes of this disclosure, a computer usable or computer readable medium can generally be any tangible apparatus that can contain, store, communicate, propagate, or transport the program for use by or in connection with the instruction execution system, apparatus, or device.

The computer usable or computer readable medium can be, for example, without limitation an electronic, magnetic, optical, electromagnetic, infrared, or semiconductor system, or a propagation medium. Non-limiting examples of a computer readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer usable or computer readable medium may contain or store a computer readable or computer usable program code such that when the computer readable or computer usable program code is executed on a computer, the execution of this computer readable or computer usable program code causes the computer to transmit another computer readable or computer usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters.

Figure 13:
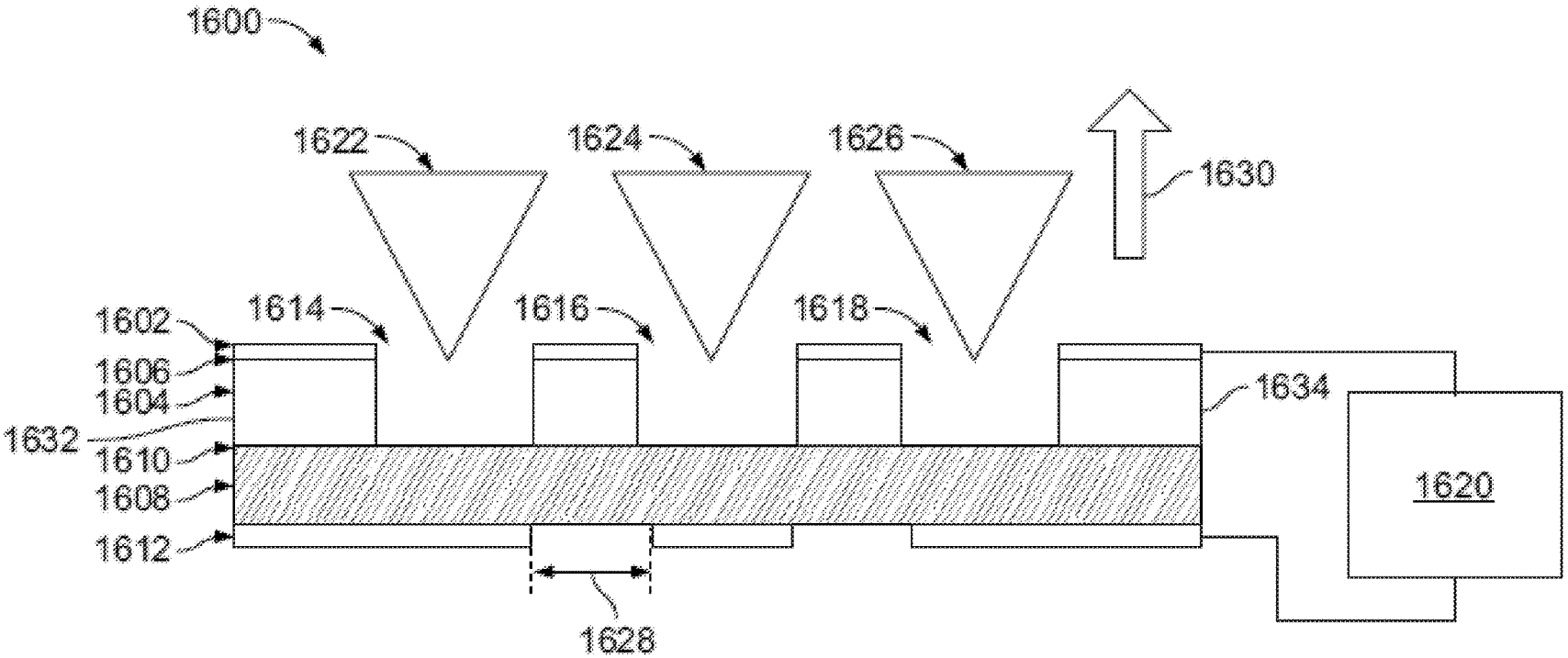
FIG. 13 illustrates a side view of an example of a thruster device, in accordance with an illustrative embodiment.

FIG. 13 illustrates an example of a thruster device 1600, in accordance with an illustrative embodiment. The thruster device 1600 includes several components. Structurally, the thruster device 1600 includes a number of layers, including a first electrode layer 1602, a dielectric layer 1604 having a first surface 1606 that is disposed on the first electrode layer 1602, a semi-conductor layer 1608 disposed on a second surface 1610 of the dielectric layer 1604 opposite the first surface 1606, and a second electrode layer 1612 disposed on the semi-conductor layer 1608 opposite the dielectric layer 1604.

The first electrode layer 1602 has a plurality of holes 1614, 1616, 1618 extending through the first electrode layer 1602. In addition, the plurality of holes 1614, 1616, 1618 extend through the dielectric layer 1604, and the semi-conductor layer 1608 is exposed to the plurality of holes 1614, 1616, and 1618. Although three holes are shown, the thruster device 1600 may include more or fewer holes depending on a size and application of the thruster device 1600, for example.

The first electrode layer 1602, the dielectric layer 1604, the semi-conductor layer 1608, and the second electrode layer 1612 may be the same or similar components as the first electrode layer 102, the dielectric layer 104, the semi-conductor layer 106, and the second electrode layer 108 shown in FIG. 1.

A power supply 1620 provides power to the first electrode layer 1602 and to the second electrode layer 1612. An applied voltage across the first electrode layer 1602 and the second electrode layer 1612, by the power supply 1620 for example, causes a plurality of plasma plumes 1622, 1624, and 1626 to be expelled toward the first electrode layer 1602 and out of the plurality of holes 1614, 1616, and 1618, respectively. For example, one plasma plume may be expelled from each of the holes. The plasma plumes 1622, 1624, and 1626 may be expelled from the semi-conductor layer 1608.

In operation, with applied voltage, the semi-conductor layer 1608 (acting as fuel supply) closes a circuit between the first electrode layer 1602 and the second electrode layer 1612, causing the plasma plumes 1622, 1624, and 1626 to be expelled acting as thrusters to propel a vehicle to which the thruster device 1600 is attached. Using a high voltage applied between the first electrode layer 1602 and the second electrode layer 1612 disposed to be spaced apart from one another causes discharge in the space between the first electrode layer 1602 and the second electrode layer 1612, and ionizes a reactive gas to form plasma. An amplitude of thrust may be estimated by known quantity of ganged thrusters and known applied voltage, as shown and described in FIG. 7 above. Each added thruster in a daisy chain ganged array increases the voltage that may be applied by the power supply 1620 to create a plasma plume, for example.

Within examples, the plurality of holes 1614, 1616, and 1618 are spaced apart by at least a diameter of a hole to prevent arcing across the plurality of holes 1614, 1616, and 1618. Example spacing 1628 is shown in FIG. 13. Another example spacing configuration of the plurality of holes 1614, 1616, and 1618 may include at least five times a diameter of a hole. An example diameter of the plurality of holes 1614, 1616, and 1618 is in a range of about 400-800 microns to concentrate the plurality of plasma plumes 1622, 1624, and 1626 in a normal vector (e.g., shown by arrow 1630) to the first electrode layer 1602, such that the plurality of plasma plumes 1622, 1624, and 1626 are expelled perpendicular to a plane of a surface of the semi-conductor layer 1608, for example.

In FIG. 13, the dielectric layer 1604 has a first end 1632 and a second end 1634, and the semi-conductor layer 1608 extends from the first end 1632 to the second end 1634 of the dielectric layer 1604 so as to extend along a length of the dielectric layer 1604, for example.

Figure 14:
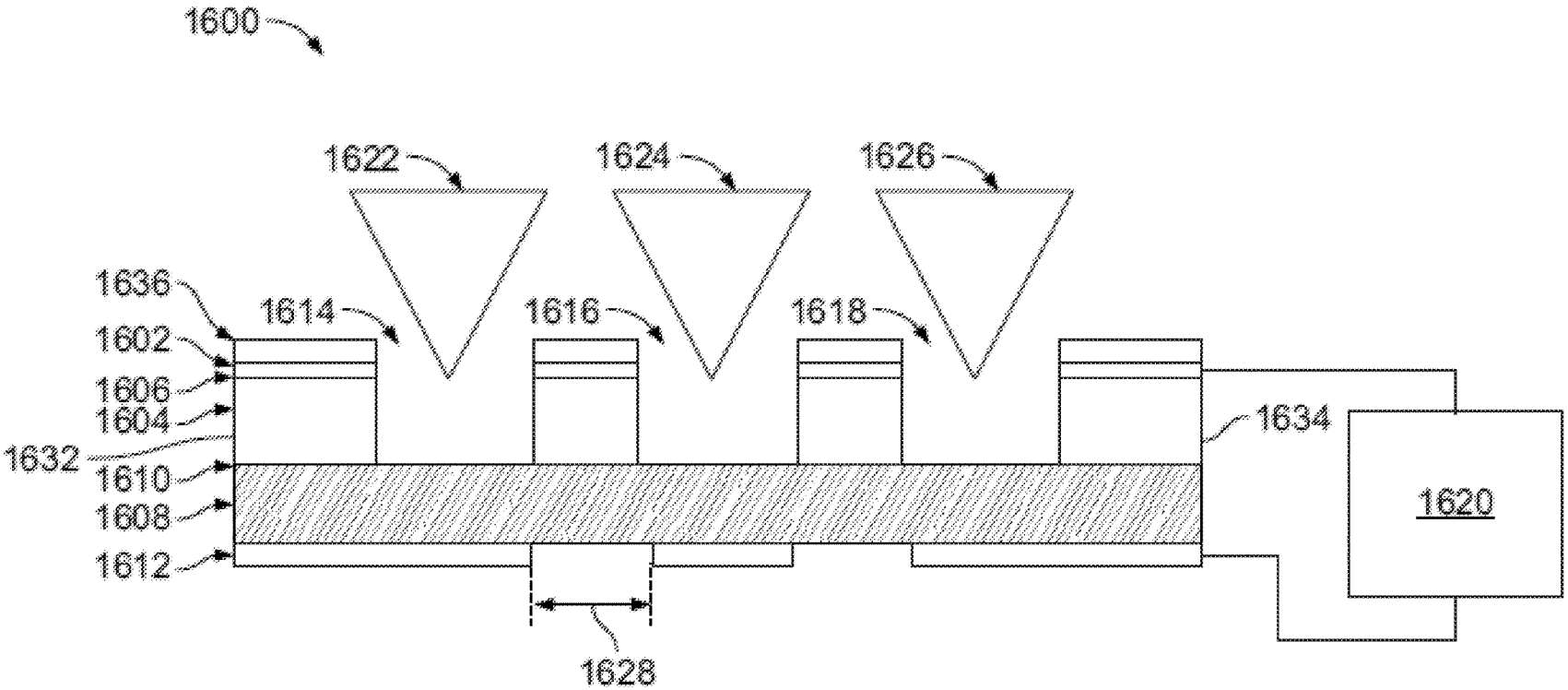
FIG. 14 illustrates a side view of an example of the thruster device with a layer of insulation, in accordance with an illustrative embodiment.

FIG. 14 illustrates an example of the thruster device 1600 with a layer of insulation 1636, in accordance with an illustrative embodiment. The layer of insulation 1636 may be positioned on the first electrode layer 1602 opposite the dielectric layer 1604. The layer of insulation 1636 may include tape products (e.g., KAPTON®), or a ceramic spray to coat the first electrode layer 1602 with Aluminum oxide and similar non-conductive material. The layer of insulation 1636 may also or alternatively include paint as well.

Figure 15:
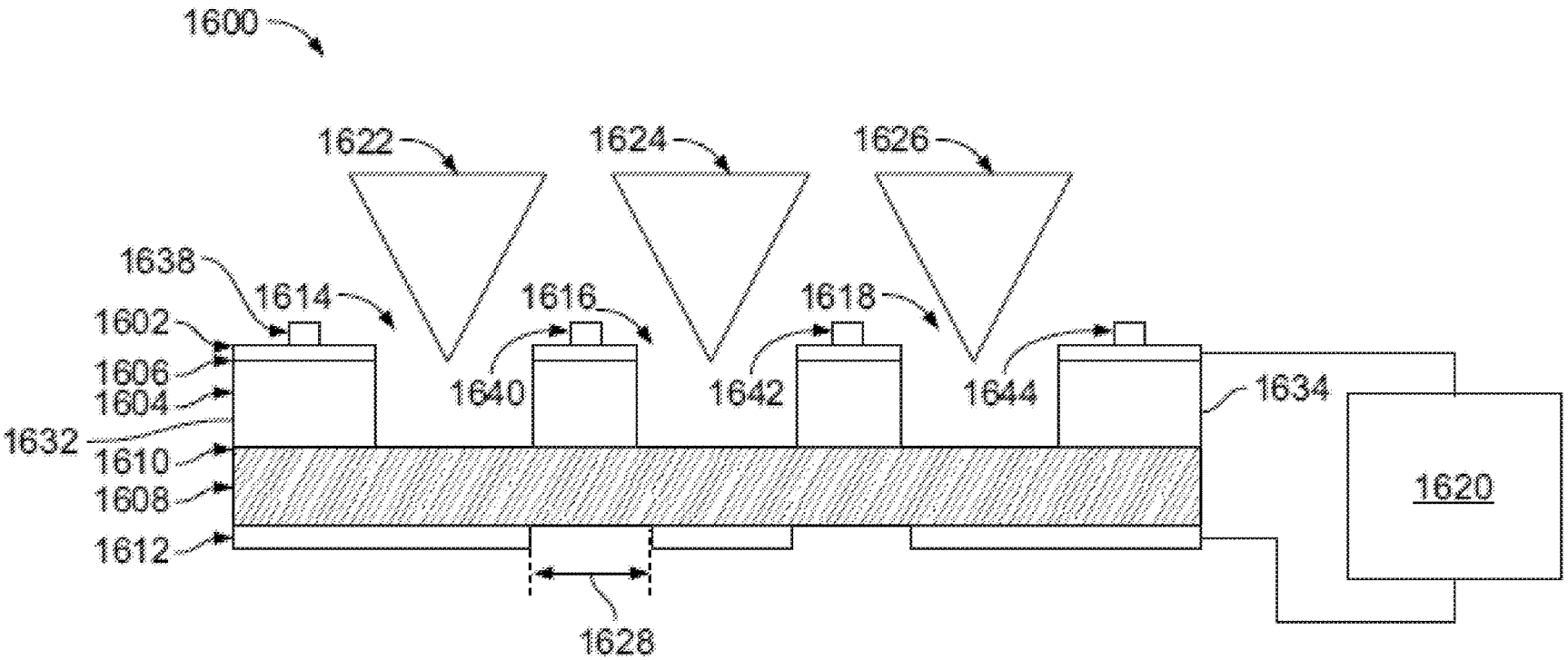
FIG. 15 illustrates a side view of an example of the thruster device with a plurality of insulators, in accordance with an illustrative embodiment.

FIG. 15 illustrates an example of the thruster device 1600 with a plurality of insulators, in accordance with an illustrative embodiment. For example, a plurality of insulators 1638, 1640, 1642, and 1644 can each insulator positioned on the first electrode layer 1602 and between adjacent holes of the plurality of holes 1614, 1616, and 1618 to prevent arcing across the plurality of holes 1614, 1616, and 1618. In this example, the plurality of insulators 1638, 1640, 1642, and 1644 can be small portions of insulation, rather than a layer of insulation along the first electrode layer 1602, for example.

In an example operation, a voltage is applied across the first electrode layer 1602 and the second electrode layer 1612 to cause the plurality of plasma plumes 1622, 1624, and 1626 to be expelled out of the plurality of holes 1614, 1616, and 1618 acting as thrusters for the thruster device 1600. The plurality of plasma plumes 1622, 1624, and 1626 penetrate into air flow surrounding the thruster device 1600 causing the thruster device 1600 to move. A larger amount of penetration by the plasma plumes 1622, 1624, and 1626 causes a larger amount of thrust possibilities. In addition, although the thruster device 1600 is shown with three holes generating the plurality of plasma plumes 1622, 1624, and 1626, a larger thruster device can be manufactured with additional holes to generate additional plasm plumes, for example.

Within examples, the thruster device 1600 may require about 20 W to provide about 1 mN of thrust, or may require about 100 W to provide about 5 mN of thrust, for example. The thruster device 1600 may yield a linear voltage drop across each plasma plume observing Ohms Law along the thruster device 1600. A propulsive force provided by the thruster device 1600 may increase with increasing power supplied by the power supply 1620. Thus, a force capability of the thruster device 1600 may be estimated by an applied voltage of the power supply 1620, for example.

A size of the plurality of holes 1614, 1616, and 1618 also can affect an amount of thrust, for example. As a size of the plurality of holes 1614, 1616, and 1618 increases, the thrust affect may decrease by having the plurality of plasma plumes 1622, 1624, and 1626 become less dense, for example.

The semi-conductor layer 1608 is a fuel source, and will be used up over time. In some examples, the semi-conductor layer 1608 may be about 1/16 of an inch thick allowing about one thousand activations for generations of plasma plume, and then the semi-conductor layer 1608 may become eroded. A thicker layer of the semi-conductor layer 1608 can be used, or a less powerful power supply 1620 can also be used as well to enable a longer lifetime of use.

As the fuel supply elevates in temperature, the fuel may no longer carry a current, causing the thruster device 1600 to pulse. This is because the semi-conductor layer 1608 inhibits an ability to close the circuit between the first electrode layer 1602 and the second electrode layer 1612 with increases in temperature. Thus, a duration of operation of the thruster device 1600 may be influenced by a temperature of the semi-conductor layer 1608. With sufficient current, a layer of the semi-conductor layer 1608 is eroded. An increase in temperature is needed for the thruster device 1600 to operate, and when a sufficient temperature is reached, plasma formation is enabled. The thruster will remain in operation until applied voltage is reduced or until depletion of fuel supply.

As mentioned, the semi-conductor layer 1608 may be a fuel supply that is composed of a carbon material, and thus, in some examples, the fuel supply may be replenished by inserting additional carbon materials.

Figure 16:
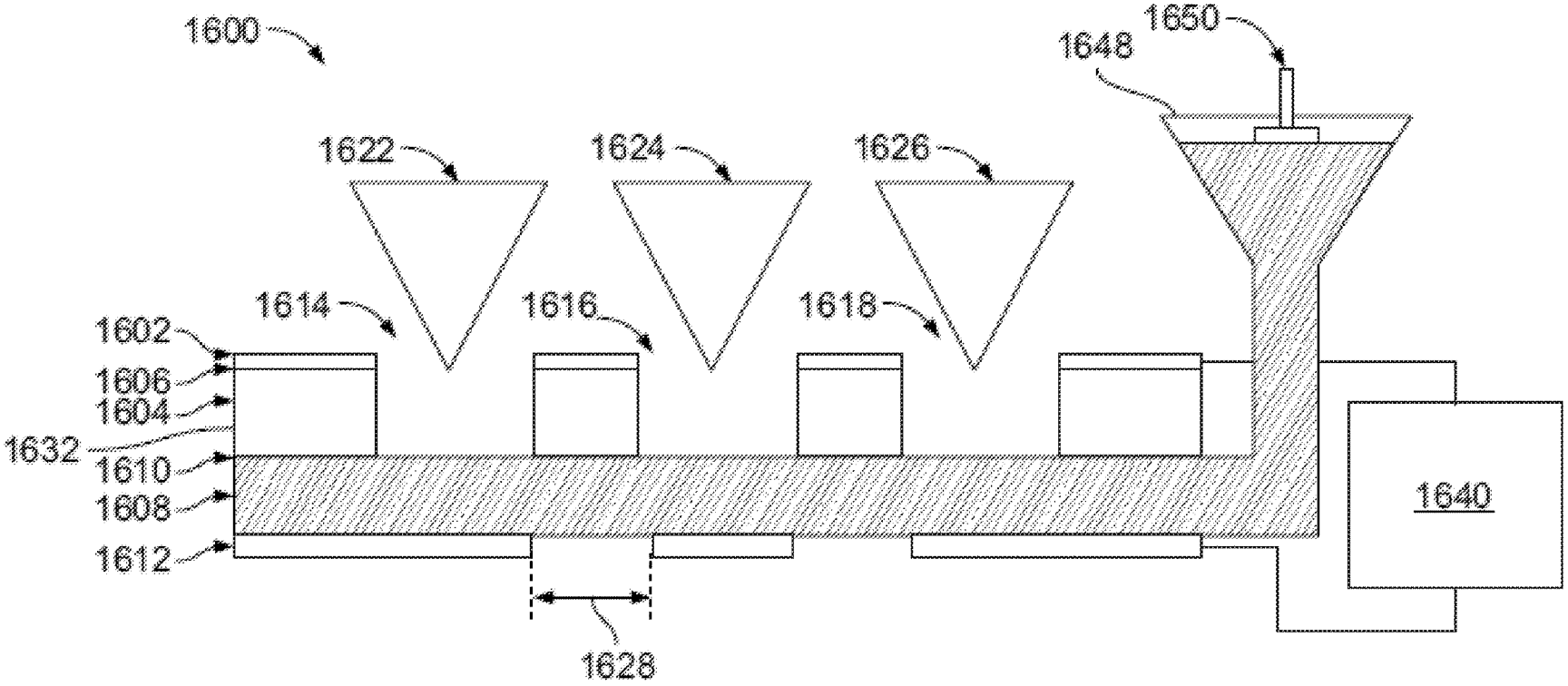
FIG. 16 illustrates a side view of an example of the thruster device with a refueling option, in accordance with an illustrative embodiment.

FIG. 16 illustrates an example of the thruster device 1600 with a refueling option, in accordance with an illustrative embodiment. In FIG. 16, the semi-conductor layer 1608 is replaced with a housing 1646 containing fuel 1648 in a gel form. An example gel form includes a solution of carbon suspended in a gel-like liquid. The fuel 1648 may also be in a powder form, such as crushed carbon. The fuel 1648 can be pushed into the housing 1646 using a plunger 1650 to keep the housing 1646 filled to replenish the fuel supply. The plunger 1650 may be powered by the power supply 1620, for example. The plunger 1650 may alternatively be spring-loaded to apply pressure to the fuel 1648.

Figure 17:
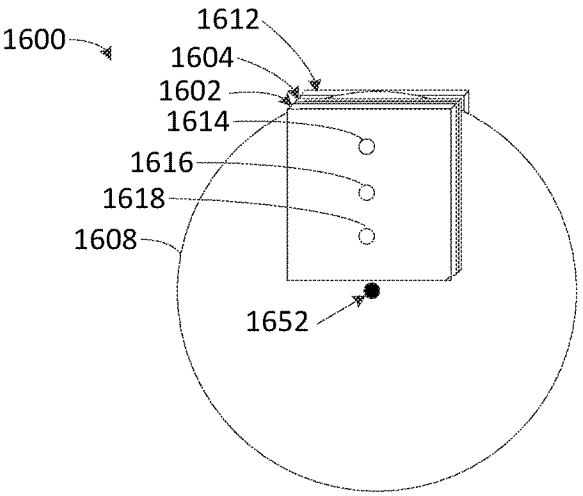
FIG. 17 illustrates a top view of an example of the thruster device with a movable semi-conductor layer, in accordance with an illustrative embodiment.
Figure 18:
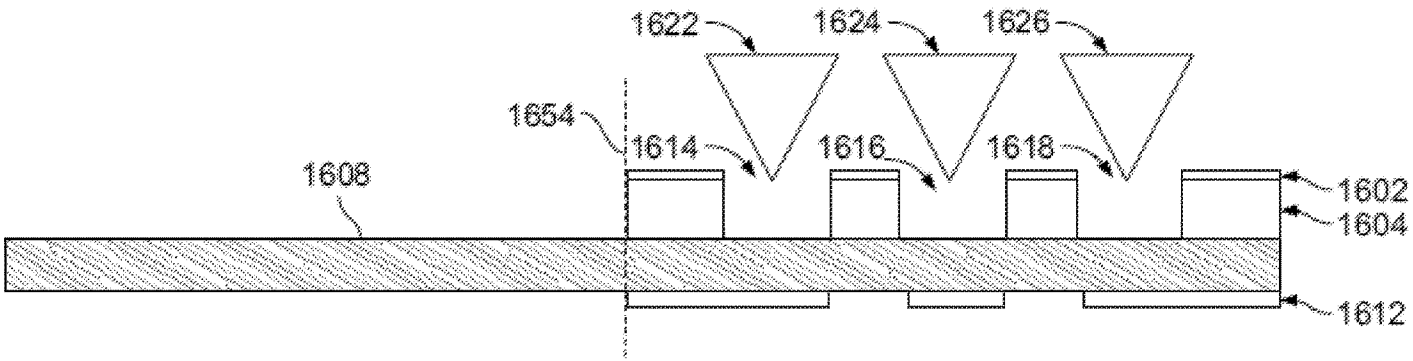
FIG. 18 illustrates a side view of the example of the thruster device in FIG. 20, in accordance with an illustrative embodiment.

FIG. 17 illustrates a top view of an example of the thruster device 1600 with a movable semi-conductor layer, in accordance with an illustrative embodiment. FIG. 18 illustrates a side view of the example of the thruster device 1600 in FIG. 17, in accordance with an illustrative embodiment. For example, the semi-conductor layer 1608 may be movable with respect to the first electrode layer 1602 and the dielectric layer 1604 so that different portions of the semi-conductor layer 1608 are exposed to the plurality of holes 1614, 1616, and 1618. This can act as a refueling option to expose unused portions of the semi-conductor layer 1608 to the plurality of holes 1614, 1616, and 1618.

In FIGS. 17-18, the semi-conductor layer 1608 is in a form of a disc that can be rotated under the plurality of holes 1614, 1616, and 1618. In this example, different sectors of the disc are exposed to the plurality of holes 1614, 1616, and 1618 over time so that used portions of the semi-conductor layer 1608 can be rotated away from the plurality of holes 1614, 1616, and 1618, and new unused portions of the semi-conductor layer 1608 can be exposed to the plurality of holes 1614, 1616, and 1618 as a refueling option. The disc can be rotated using a point of rotation 1652, and along an axis of rotation 1654 as shown in FIGS. 17-18.

In some examples, the disc can be rotated slowly or in a stepped fashion so that portions of the semi-conductor layer 1608 are used substantially equally over time. In other examples, the disc can be rotated after a specific portion of the semi-conductor layer 1608 is entirely used, such after about one thousand activations, for example.

Figure 19:
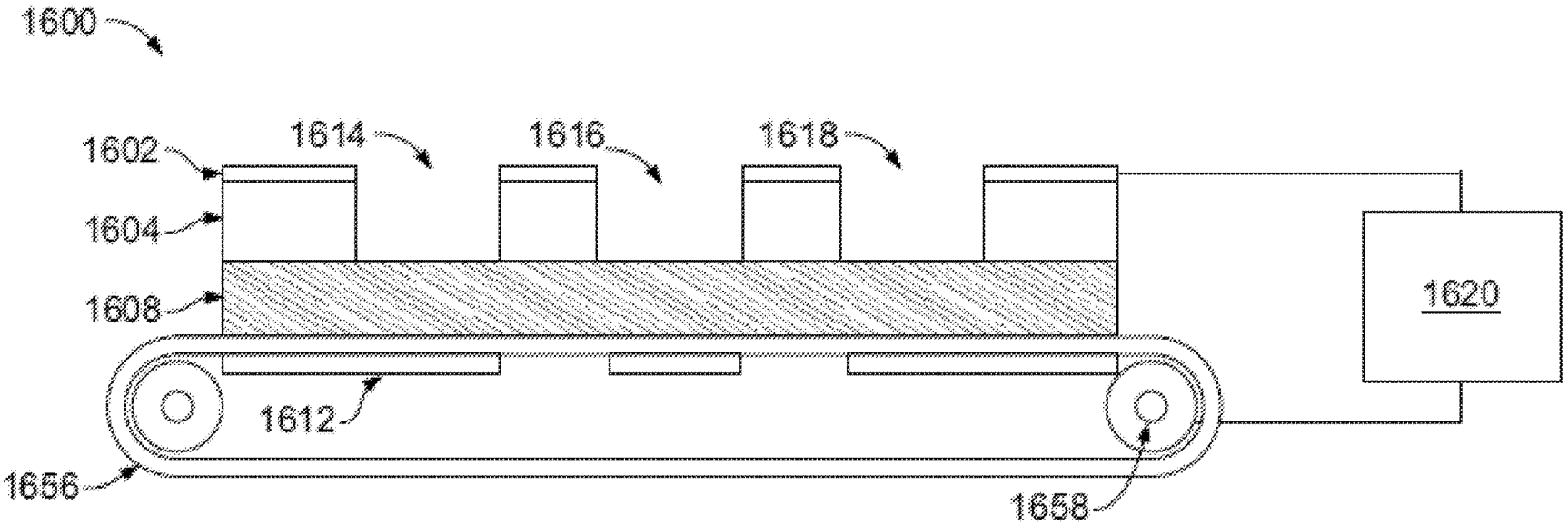
FIG. 19 illustrates a side view of another example of the thruster device with a movable semi-conductor layer, in accordance with an illustrative embodiment.

FIG. 19 illustrates a side view of another example of the thruster device 1600 with a movable semi-conductor layer, in accordance with an illustrative embodiment. In FIG. 19, the second electrode layer 1612 is positioned on a conveyor belt 1656 that is powered by a belt drive system 1658, which is connected to the power supply 1620. As the conveyor belt 1656 moves, the semi-conductor layer 1608 moves as well enabling different portions of the semi-conductor layer 1608 to be exposed to the plurality of holes 1614, 1616, and 1618.

The conveyor belt 1656 may be conductive allowing the second electrode layer 1612 to conduct to the semi-conductor layer 1608 for operation of the thruster device 1600.

In the example shown in FIG. 19, the belt drive system 1658 may move the conveyor belt 1656 a fixed amount over time to ensure that unused portions of the semi-conductor layer 1608 are under the plurality of holes 1614, 1616, and 1618. The conveyor belt 1656 may move the semi-conductor layer 1608 once portions of the semi-conductor layer 1608 become used, and thus, the conveyor belt 1656 may move after every one thousand activations, for example. The conveyor belt 1656 may move the semi-conductor layer 1608 an amount equal to a total of widths of the plurality of holes 1614, 1616, and 1618, or may move the semi-conductor layer 1608 an amount equal to one spacing width of the plurality of holes 1614, 1616, and 1618 to provide unused portions of the semi-conductor layer 1608 in-line with the plurality of holes 1614, 1616, and 1618, for example.

In an alternate example, the conveyor belt 1656 may be the fuel source and the semi-conductor layer 1608 is eliminated.

Figure 20:
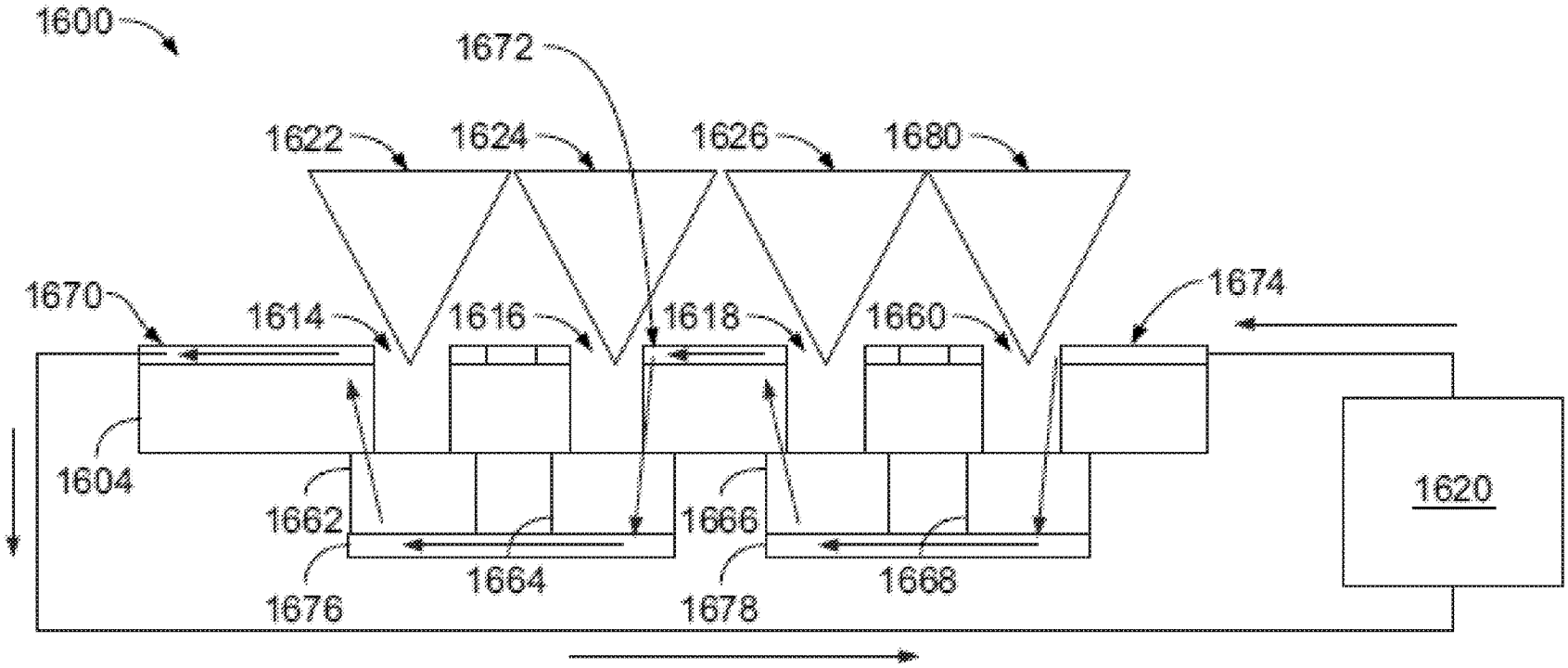
FIG. 20 illustrates a side view of another example of the thruster device with multiple thrusters, in accordance with an illustrative embodiment.
Figure 21:
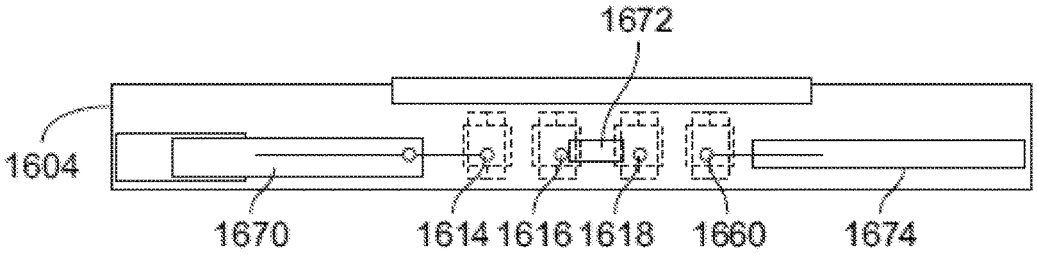
FIG. 21 illustrates a top view of the thruster device of FIG. 23, in accordance with an illustrative embodiment.
Figure 22:
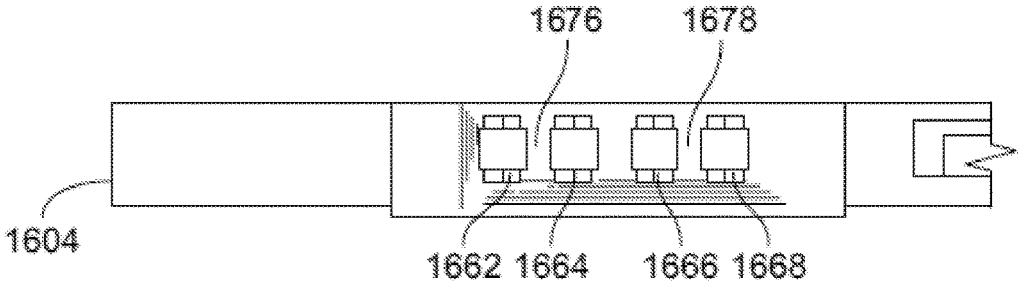
FIG. 22 illustrates a bottom view of the thruster device of FIG. 23, in accordance with an illustrative embodiment.

FIGS. 20-22 illustrate another example of the thruster device 1600 with multiple thrusters, in accordance with an illustrative embodiment. FIG. 20 illustrates a side view of the thruster device 1600, which in this example, includes four holes 1614, 1616, 1618, and 1660. FIG. 21 illustrates a top view of the thruster device 1600 of FIG. 20, and FIG. 22 illustrates a bottom view of the thruster device 1600 of FIG. 20.

In these examples in FIGS. 20-22, the semi-conductor layer 1608 is shown as a plurality of semi-conductor layer strips 1662, 1664, 1666, and 1668, and each strip spans across a respective hole of the plurality of holes 1614, 1616, 1618, and 1660. In addition, the first electrode layer 1602 also may include first electrode layer strips 1670, 1672, and 1674, and the second electrode layer 1612 may include second electrode layer strips 1676 and 1678.

In FIGS. 20-22, strips of material may be spaced apart by an amount equal to a diameter of the plurality of holes 1614,

1616, 1618, and 1660, or larger spacing may be used to provide further protection from arcing, for example, In operation, current flows from the power supply 1620 to the first electrode layer strip 1674 and down to the second electrode layer strip 1678 through the semi-conductor layer strip 1668, and continues through the semi-conductor layer strip 1666 up to the first electrode layer strip 1672. From there, the current travels down to the second electrode layer strip 1676 through the semi-conductor layer strip 1664, and continues through the semi-conductor layer strip 1662 up to the first electrode layer strip 1670. The flow of current causes generation of the plurality of plasma plumes 1622, 1624, 1626, and 1680 out of the plurality of holes 1614, 1616, 1618, and 1660. The flow of current is similar to a serpentine pattern using the strips of layers, as shown in examples in FIGS. 20-22.

As shown in FIG. 21, the plurality of holes 1614, 1616, 1618, and 1660 may be drilled out of the dielectric layer 1604, and pieces of metal may be positioned for the strips of the first electrode and second electrode layers. Spacing between the plurality of holes 1614, 1616, 1618, and 1660 may be at least about the diameter of the holes, or five times a diameter of the holes, to prevent arcing across a front-side of the nozzles, as shown in FIG. 21. Similarly, spacing between each back-side electrode strip, e.g., second electrode layer strip 1676 and 1678, may also be of at least a diameter of the holes, or five times a diameter of the holes, to prevent arcing. An example spacing on the front side and/or back side may be about ¼ or ½ inch apart between holes and/or electrode strips.

Figure 23:
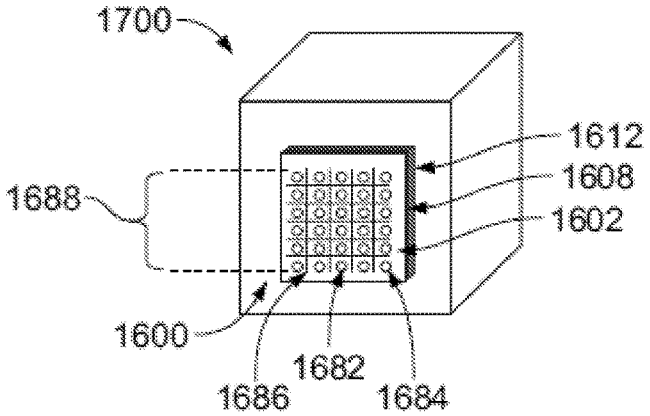
FIG. 23 illustrates a three-dimensional view of an example satellite including the thruster device, in accordance with an illustrative embodiment.

FIG. 23 illustrates a three-dimensional view of an example satellite 1700 including the thruster device 1600, in accordance with an illustrative embodiment. The thruster device 1600 may be operated to maneuver the satellite 1700 in space, for example. The satellite 1700 may be a square satellite having dimensions 10 cm×10 cm×10 cm, for example, and the thruster device 1600 may be about 5 cm×5 cm.

The thruster device 1600 can thus be included on small scale spacecraft (e.g., nanosatellites) and provides an easy retrofit to existing platforms. The thruster device 1600 is lightweight and thin-profile, such that spacecraft mass may be allocated to the payload for vehicle performance.

The thruster device 1600 is shown including a plurality of plasma plume nozzles, such as nozzles 1682 and 1684, arranged in parallel. Each plasma plume nozzle includes a layering of the first electrode layer 1602, the dielectric layer 1604, the semi-conductor layer 1608, and the second electrode layer 1612. The layering includes the holes extending through the first electrode layer 1602 and the dielectric layer 1604 to expose the semi-conductor layer 1608, and an applied voltage across the first electrode layer 1602 and the second electrode layer 1612 causes the plasma plume to be expelled toward the first electrode layer 1602 and out of the holes. Each of the holes may be considered a plasma plume nozzle.

The thruster device also includes a plurality of insulators 1686 positioned between the plurality of plasma plume nozzles 1682 and 1684 to prevent arcing across the plurality of nozzles 1682 and 1684. The plurality of insulators 1686 are shown in a checkerboard layout between the plurality of nozzles 1682 and 1684.

One layering of the materials may be used to create all of the plurality of plasma plume nozzles shown in FIG. 23. For example, the nozzles 1682 and 1684 are arranged using the first electrode layer 1602, the dielectric layer 1604, the semi-conductor layer 1608, and the second electrode layer 1612, and the layering includes the plurality of holes 1614, 1616, and 1618 extending through the first electrode layer 1602 and the dielectric layer 1604 to expose the semi-conductor layer 1608, and a respective plasma plume nozzle has an associated respective hole.

A length of a plasma plume nozzle is proportionate to a thickness of the dielectric layer 1604. The first electrode layer 1602 and the second electrode layer 1612 may be thin as compared to the dielectric layer 1604, and thus, the thickness of the dielectric layer 1604 generally controls a length of the plasma plume nozzle, for example.

The plasma plume nozzles of the thruster device 1600 can be arranged to create a matrix of nozzles 1688. However, the plasma plume nozzles of the thruster device 1600 can be arranged in any manner, such as in series (like shown in FIGS. 20-22), or parallel in a matrix form. In addition, any number of plasma plume nozzles may be created depending on a size of the thruster device 1600. In some examples, the plasma plume nozzles may be arranged in series for an array of thrusters, for example. In still further examples, the plasma plume nozzles may be arranged in other geometric configurations to provide thrust in specific directions and orientations, for example.

In operation for the thruster device 1600 shown in FIG. 23, the voltage is applied across the first electrode layer 1602 and the second electrode layer 1612 of two or more of the plurality of plasma plume nozzles to cause plasma plumes to be expelled from the two or more of the plurality of plasma plume nozzles in parallel. In addition, the voltage is applied across the first electrode layer 1602 and the second electrode layer 1612 of two or more of the plurality of plasma plume nozzles to cause plasma plumes to be expelled from the two or more of the plurality of plasma plume nozzles in a substantially simultaneous manner. Thus, all plasma plume nozzles of the matrix of nozzles 1688 can be activated at once, or less than all can be activated in a given time duration to provide a desired thrust. An example operation includes 100 microsecond length pulses of thrust activated once every millisecond to cause the satellite to maneuver in a desired direction. A thruster with one hundred nozzles may be able to generate 100 mN of thrust, for example.

Figure 24:
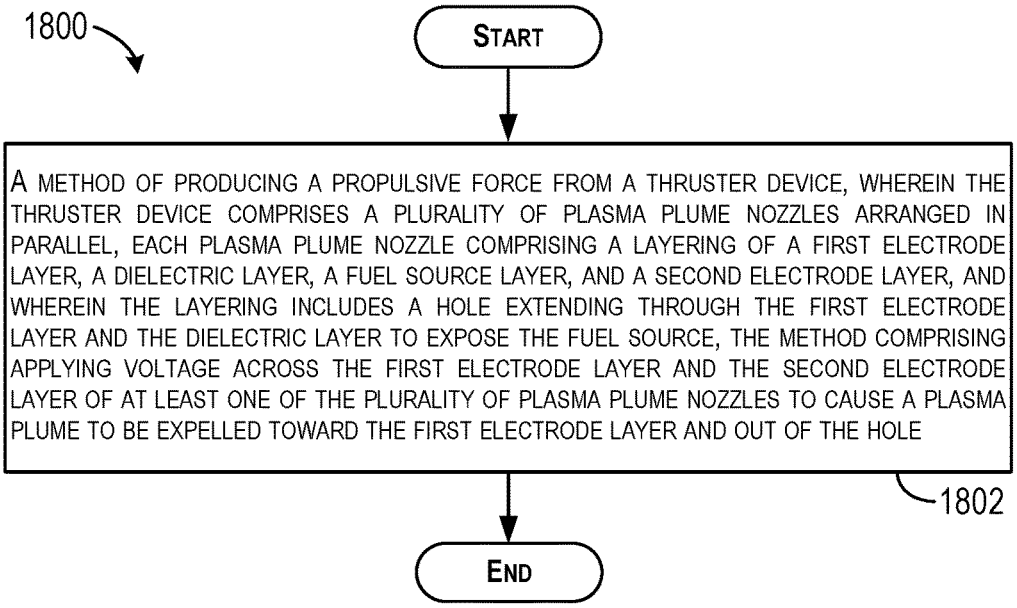
FIG. 24 is a flowchart of a method of producing a propulsive force from the thruster device, in accordance with an illustrative embodiment.

FIG. 24 is a flowchart of a method of producing a propulsive force from the thruster device 1600, in accordance with an illustrative embodiment. Method 1800 may be implemented using a semi-conducting micro-hollow cathode discharge device, such as those described with respect to FIG. 1 through FIG. 4, and FIG. 9, and/or with the thruster device 1600 shown in FIGS. 13-23.

Thus, method 1800 may be a method of producing a propulsive force from the thruster device 1600, wherein the thruster device 1600 comprises the plurality of plasma plume nozzles 1682 and 1684 arranged in parallel, and each plasma plume nozzle comprising a layering of the first electrode layer 1602, the dielectric layer 1604, the semi-conductor layer 1608, and the second electrode layer 1612, and wherein the layering includes a hole 1614/1616/1618 extending through the first electrode layer 1602 and the dielectric layer 1604 to expose the semi-conductor layer 1608, and the method comprises applying voltage across the first electrode layer 1602 and the second electrode layer 1612 of at least one of the plurality of plasma plume nozzles 1682 and 1684 to cause a plasma plume to be expelled toward the first electrode layer 1602 and out of the hole (operation 1802)

This method may be varied. In just one example, generating the plasma plume may include generating the plasma plume to be greater than about 3 millimeters long. Further variations are possible.

Figure 25:
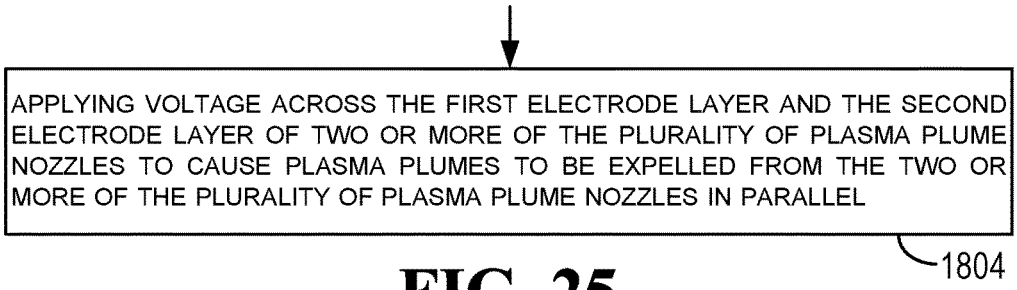
FIG. 25 shows a flowchart of an example method for use with the method in FIG. 24, according to an example implementation.

FIG. 25 shows a flowchart of an example method for use with the method in FIG. 24, according to an example implementation. Method 1800 may include applying voltage across the first electrode layer 1602 and the second electrode layer 1612 of two or more of the plurality of plasma plume nozzles 1682 and 1684 to cause plasma plumes to be expelled from the two or more of the plurality of plasma plume nozzles 1682 and 1684 in parallel (operation 1804).

Method 1800 may be further varied. For example, as described above, different materials may be used. Different arrangements and shapes of the various layers may also be used. Accordingly, the illustrative embodiments are not necessarily limited by the example of FIG. 25, or the examples described above with respect to the other figures.

Figure 26:
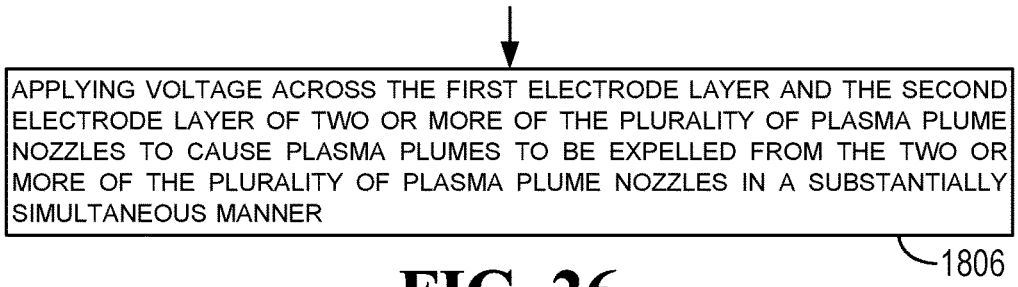
FIG. 26 shows a flowchart of another example method for use with the method in FIG. 24, according to an example implementation.

FIG. 26 shows a flowchart of another example method for use with the method in FIG. 24, according to an example implementation. Method 1800 may include applying voltage across the first electrode layer 1602 and the second electrode layer 1612 of two or more of the plurality of plasma plume nozzles 1682 and 1684 to cause plasma plumes to be expelled from the two or more of the plurality of plasma plume nozzles 1682 and 1684 in a substantially simultaneous manner (operation 1806). Within examples, a propulsive force is thus provided via expelling the plasma plumes through two or more plasma plume nozzles in series.

The thruster device 1600 is operable in in various gaseous environments, and the semi-conductor layer 1608 is the source of propulsive force (rather than a chemical reaction between carbon fuel and external gaseous environment (i.e., burning in Air)). The thruster device 1600 may provide a propulsive force in the presence of Air (mixed fluid), Nitrogen (N2), Helium (He), and a Vacuum of 5E-6 Torr, for example. The thruster device 1600 does not require an injector or any spark-plug for operation enabling a lightweight and thin-profile structure.

The illustrative embodiments described herein may be varied from the examples described above with respect to FIG. 1 through FIG. 26. For example, multiple semi-conducting micro-hollow cathode discharge devices may be arranged in a row as a single device, with each semi-conducting micro-hollow cathode discharge device attached to a single power supply in series. Thus, a row of jets or thrusters may be generated. Other arrangements are possible. For example, multiple coordinated power supplies may be used for multiple semi-conducting micro-hollow cathode discharge devices. The semi-conducting micro-hollow cathode discharge devices may be arranged in different patterns, such as circular or elliptical or some other pattern, and thus are not limited to a row. Multiple coordinated semi-conducting micro-hollow cathode discharge devices may be arranged in a three-dimensional pattern on a larger apparatus by placing different semi-conducting micro-hollow cathode discharge devices on different parts of the larger apparatus. Thus, many different arrangements of multiple semi-conducting micro-hollow cathode discharge devices are possible.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the disclosure.

What is claimed is:

1. A thruster device comprising: a first electrode layer having a plurality of holes extending through the first electrode layer; a dielectric layer having a first surface that is disposed on the first electrode layer, wherein the plurality of holes extend through the dielectric layer; a semi-conductor layer disposed on a second surface of the dielectric layer opposite the first surface, wherein the semi-conductor layer is exposed to the plurality of holes, wherein the semi-conductor layer comprises a plurality of strips of semi-conductor, and each strip of the plurality of strips of semi-conductor spans across a respective hole of the plurality of holes; and a second electrode layer disposed on the semi-conductor layer opposite the dielectric layer, wherein an applied voltage across the first electrode layer and the second electrode layer causes a plurality of plasma plumes to be expelled toward the first electrode layer and out of the plurality of holes.

2. The thruster device of claim 1, wherein the plurality of holes are spaced apart by at least a diameter of a hole of the plurality of holes to prevent arcing across the plurality of holes.

3. The thruster device of claim 1, wherein a diameter of each hole of the plurality of holes is in a range of 400-800 microns to concentrate the plurality of plasma plumes in a normal vector to the first electrode layer.

4. The thruster device of claim 1, wherein the semi-conductor layer comprises carbon tape.

5. The thruster device of claim 1, wherein the dielectric layer has a first end and a second end, and wherein the semi-conductor layer extends from the first end to the second end of the dielectric layer.

6. The thruster device of claim 1, further comprising a layer of insulation positioned on the first electrode layer opposite the dielectric layer.

7. The thruster device of claim 1, further comprising a plurality of insulators, wherein each insulator of the plurality of insulators is positioned on the first electrode layer and between adjacent holes of the plurality of holes to prevent arcing across the plurality of holes.

8. The thruster device of claim 1, wherein semi-conductor layer is movable with respect to the first electrode layer and the dielectric layer so that different portions of the semi-conductor layer are exposed to the plurality of holes.

9. A thruster device comprising: a plurality of plasma plume nozzles arranged in parallel, each plasma plume nozzle of the plurality of plasma plume nozzles comprising a layering of a first electrode layer, a dielectric layer, a semi-conductor layer, and a second electrode layer, and wherein the layering includes a hole extending through the first electrode layer and the dielectric layer to expose the semi-conductor layer, wherein an applied voltage across the first electrode layer and the second electrode layer causes a plasma plume to be expelled toward the first electrode layer and out of the hole; and a plurality of insulators positioned between the plurality of plasma plume nozzles to prevent arcing across the plurality of plasma plume nozzles.

10. The thruster device of claim 9, wherein a diameter of the hole is in a range of 400-800 microns to concentrate the plasma plume in a normal vector to the first electrode layer.

11. The thruster device of claim 9, wherein all of the plurality of plasma plume nozzles are arranged using the first electrode layer, the dielectric layer, the semi-conductor layer, and the second electrode layer, and wherein the layering includes a plurality of holes extending through the first electrode layer and the dielectric layer to expose the semi-conductor layer, wherein a respective plasma plume nozzle of the plurality of plasma plume nozzles has an associated respective hole of the plurality of holes.

12. The thruster device of claim 11, wherein the dielectric layer has a first end and a second end, and wherein the semi-conductor layer extends from the first end to the second end of the dielectric layer.

13. The thruster device of claim 11, wherein the semi-conductor layer comprises a plurality of strips of semi-conductor, and each strip of the plurality of strips of semi-conductor spans across a respective hole of the plurality of holes.

14. The thruster device of claim 11, wherein the semi-conductor layer is movable with respect to the first electrode layer and the dielectric layer so that different portions of the semi-conductor layer are exposed to the plurality of holes.

15. The thruster device of claim 9, wherein a length of a plasma plume nozzle of the plurality of plasma plume nozzles is proportionate to a thickness of the dielectric layer.

16. The thruster device of claim 9, further comprising additional plasma plume nozzles configured with the plurality of plasma plume nozzles arranged to create a matrix of nozzles.

17. A method of producing a propulsive force from a thruster device, wherein the thruster device comprises a plurality of plasma plume nozzles arranged in parallel, each plasma plume nozzle comprising a layering of a first electrode layer, a dielectric layer, a semi-conductor layer, a second electrode layer, and a plurality of insulators positioned between the plurality of plasma plume nozzles to prevent arcing across the plurality of plasma plume nozzles, and wherein the layering includes a hole extending through the first electrode layer and the dielectric layer to expose the semi-conductor layer, the method comprising:

applying voltage across the first electrode layer and the second electrode layer of at least one of the plurality of plasma plume nozzles to cause a plasma plume to be expelled toward the first electrode layer and out of the hole.

18. The method of claim 17, further comprising:

applying voltage across the first electrode layer and the second electrode layer of two or more of the plurality of plasma plume nozzles to cause plasma plumes to be expelled from the two or more of the plurality of plasma plume nozzles in parallel.

19. The method of claim 17, further comprising:

applying voltage across the first electrode layer and the second electrode layer of two or more of the plurality of plasma plume nozzles to cause plasma plumes to be expelled from the two or more of the plurality of plasma plume nozzles in a substantially simultaneous manner.

20. The thruster device of claim 9, wherein the semi-conductor layer comprises carbon tape.

* * * * *